US012637117B2

(12) United States Patent
Bocchieri et al.

(10) Patent No.: US 12,637,117 B2
(45) Date of Patent: May 26, 2026

(54) END ENCLOSURE FOR LIGHT RAIL VEHICLES

(71) Applicant: Applied Research Associates, Inc., Albuquerque, NM (US)

(72) Inventors: Robert T. Bocchieri, Los Altos, CA (US); Alexander D. Zeigle, Los Altos, CA (US); Steven W. Kirkpatrick, Los Altos, CA (US); Travis Lowe, Randolph, VT (US)

(73) Assignee: Applied Research Associates, Inc., Albuquerque, NM (US)

( * ) Notice: Subject to any disclaimer, the term of this patent is extended or adjusted under 35 U.S.C. 154(b) by 880 days.

(21) Appl. No.: 17/957,322

(22) Filed: Sep. 30, 2022

(65) Prior Publication Data

US 2024/0109563 A1 Apr. 4, 2024

(51) Int. Cl.
*B61F 19/04* (2006.01)
*B61D 15/06* (2006.01)
(Continued)

(52) U.S. Cl.
CPC ..... *B61F 19/04* (2013.01); *B61D 15/06* (2013.01); *B61D 17/00* (2013.01); *B61D 17/06* (2013.01);
(Continued)

(58) Field of Classification Search
CPC ..... B61D 15/06; B61D 17/06; B61F 19/04; B61G 11/16; B61G 7/10; B61C 17/04
See application file for complete search history.

(56) References Cited

U.S. PATENT DOCUMENTS 440,729 A * 11/1890 Upton ..... B61D 15/06 105/6
7,810,437 B2 * 10/2010 Mattschull ..... B61D 17/06 213/220
(Continued)

FOREIGN PATENT DOCUMENTS

CN 107472285 A * 12/2017 ..... B61G 11/00
CN 115027513 A * 9/2022 ..... B61F 19/04
(Continued)

OTHER PUBLICATIONS

Bocchieri, Robert T. et al.; Collision Safety Improvements for LRVs Operating in Shared Right of Way Street Environments; U.S. Department of Transportation; Federal Transit Administration; 2009; pp. 1-19.
(Continued)

*Primary Examiner* — Zachary L Kuhfuss
(74) *Attorney, Agent, or Firm* — Erise IP, P.A.

(57) ABSTRACT

An enclosure system attachable to a railway vehicle to protect automobiles in the event of a collision. The enclosure system having an enclosure panel that is actuatable between a deployed configuration and a stowed configuration. A breakaway mechanism configured to allow certain components of enclosure system to release from the railway vehicle in the event of a collision with another railway vehicle to ensure the anticlimbers engage between the railway vehicles to prevent override. The enclosure system having a coupler centering assembly for maintaining a coupler in a forward position when the enclosure is in the deployed configuration.

20 Claims, 18 Drawing Sheets

(51) Int. Cl.

| | |
|---|---|
| ***B61D 17/00*** | (2006.01) |
| ***B61D 17/06*** | (2006.01) |
| ***B61F 1/10*** | (2006.01) |
| ***B61F 19/06*** | (2006.01) |
| ***B61G 7/14*** | (2006.01) |
| ***B61G 11/16*** | (2006.01) |
| *B61G 7/10* | (2006.01) |

(52) U.S. Cl.
CPC ..... *B61F 1/10* (2013.01); *B61F 19/06* (2013.01); *B61G 7/14* (2013.01); *B61G 11/16* (2013.01); *B61G 7/10* (2013.01)

(56) References Cited

U.S. PATENT DOCUMENTS

| | | | | |
|---|---|---|---|---|
| 10,562,544 | B2 * | 2/2020 | Kammerloher | B61D 17/06 |
| 12,012,155 | B2 * | 6/2024 | Dix | B61G 7/12 |
| 2010/0064931 | A1 * | 3/2010 | Heinisch | B61D 15/06 213/7 |
| 2011/0296762 | A1 * | 12/2011 | Ahrens | B61D 17/06 49/340 |
| 2013/0042788 | A1 * | 2/2013 | Scholz | B61D 17/06 105/413 |
| 2013/0133547 | A1 * | 5/2013 | Heinisch | B61D 17/00 105/413 |
| 2017/0197640 | A1 * | 7/2017 | Koch | E05F 15/00 |
| 2018/0094473 | A1 * | 4/2018 | Liu | E05F 15/00 |

FOREIGN PATENT DOCUMENTS

| | | | | |
|---|---|---|---|---|
| DE | 29706073 U1 * | 7/1997 | ..... | B61D 17/06 |
| JP | 2005145268 A * | 6/2005 | ..... | B61D 17/00 |

OTHER PUBLICATIONS

Bocchieri, Robert T. et al.; Collision Safety Improvements for Light Rail Vehicles Operating in Shared Right of Way Street Environments; APTA Rail Conference; Jun. 6-9, 2010; pp. 1-18; Vancouver, British Columbia.

Kirkpatrick, Steven; Development of Crash Energy Management Performance Requirements for Light Rail Vehicles; Transportation Research Board; Transit Cooperative Research Program; Mar. 2008; pp. 1-147; Washington, DC.

Bocchieri, Robert T. et al.; LRV Bumper Safety Technology Deployment; Federal Transit Administration; CUTR/FTA Transit Standards Working Group; Oct. 27-28, 2021; pp. 1-17.

Bocchieri, Robert T. et al.; Collision Safety Improvements for Light Rail Vehicles Operating in Shared Right of Way Street Environments; U.S. Department of Transportation; Federal Transit Administration; Sep. 30, 2009; pp. 1-66.

Valley Metro starts deploying Siemens' S700 LRVs for commercial service; Railway Technology; Jan. 11, 2022; pp. 1-4; https://www.railway-technology.com/news/valley-metro-siemens-lrvs/; retrieved on Sep. 21, 2022.

Swanson, John D.; Saving Lives and Reducing Costs Through Crashworthy Light Rail Vehicle Design; APTA Rail Conference; Jun. 11-14, 2017; pp. 1-27.

* cited by examiner

END ENCLOSURE FOR LIGHT RAIL VEHICLES

BACKGROUND

1. Field

Embodiments of the present disclosure relate to enclosures for vehicles. More specifically, embodiments of the present disclosure relate to enclosures for light rail vehicles.

2. Related Art

A significant problem in current light rail systems is the lack of safety mechanisms to prevent or significantly preclude negative outcomes in the event of a crash of a railway vehicle with an automobile. In many instances, light rail vehicles (LRVs) lack a safety enclosure or other protective barrier located on the front end of the leading car. As such, a collision of the railway vehicle with any other object can cause significant damage to both the other object and the railway vehicle.

A feature of most railway vehicles is to operatively engage or disengage one or more cars on either side so as to easily expand or downsize the length of the train. For example, to extend the length of a train, a car may connect to another car at the front end, making the new car the lead car. These connections require a stable securing mechanism, called a coupler, extending from the front of the first car that connects to a similar securing mechanism extending from the rear of the second car. Additionally, once secured to one another, the securing mechanisms of both cars need to be rotatable around an axis that allows for the cars to move separate from one another while still attached (e.g., as the train rounds a corner). For this reason, many current railway vehicles lack an end enclosure, as this would impede the needed connection mechanism.

Complete replacement of currently operating railway vehicles to incorporate railway vehicles having an end enclosure would be extremely costly and time consuming. Accordingly, what is currently needed in the art is an actuatable portion of the enclosure for railway vehicles that can be retrofitted to attach to presently operating railway vehicles. Such an enclosure would significantly reduce damages, injuries, and deaths resulting from railway vehicle collisions with automobiles.

SUMMARY

Embodiments of the present invention solve the above-mentioned problems by providing a system and device for an actuatable enclosure that may be retrofitted to currently operating railway vehicles or manufactured as an original part of a railway vehicle. Portions of the enclosure may actuate between a deployed configuration and a stowed configuration, thereby allowing each car to couple to one another when the end enclosure is in the stowed configuration. When in the stowed configuration, the enclosure does not block required aspects or operation of the railway vehicle, such as the operator's line of sight. Additional features of the enclosure provide significant safety features in the case of railway vehicle collision with other railway vehicles, such as breakaway panels that ensure the anti-climbers engage between cars to prevent override. In other embodiments, the enclosure is an original equipment manufacturer (OEM) of the railway vehicle and is not retrofitted to the railway vehicle. In other embodiments, portions of the enclosure system are OEM of the railway vehicle (e.g., the breakaway system) while other portions of the enclosure system are retrofitted on the railway vehicle (e.g., the enclosure panel).

A first embodiment of the present disclosure is directed to a railway vehicle enclosure apparatus, including: an enclosure panel; one or more actuation systems, each including an actuating cylinder adapted to actuate the enclosure panel between a stowed configuration and a deployed configuration; and a breakaway system engaging lateral sides of the enclosure panel when in the deployed configuration, the breakaway system including: at least one breakaway panel abutting the lateral sides of the enclosure panel at a first end and configured to detach from the railway vehicle enclosure apparatus upon a force being exerted on the enclosure panel; and at least one breakaway block each having a guide slot, wherein the guide slot and the at least one breakaway block transiently maintain a position of the at least one breakaway panel.

A second embodiment of the present disclosure is directed to an enclosure system for a railway vehicle, the enclosure system including: an enclosure panel; and a breakaway system engaging lateral sides of the enclosure panel, the breakaway system including: at least one breakaway panel abutting the lateral sides of the enclosure panel at a first end; one or more breakaway blocks transiently maintaining a position of the at least one breakaway panel; and one or more shear blocks engaging the at least one breakaway panel at a second end, the one or more breakaway blocks and the one or more shear blocks are configured to guide the at least one breakaway panel upon a force being exerted on the enclosure panel.

A third embodiment of the present disclosure is directed to an enclosure system for a railway vehicle, the enclosure system including: an enclosure panel; and one or more actuation mechanisms coupled to the enclosure panel, the one or more actuation mechanisms including: one or more linkage arms coupled to the enclosure panel; one or more linkage drive cranks coupled to the one or more linkage arms; and one or more actuating cylinders configured to drive rotation of the one or more linkage drive cranks, wherein rotation of the one or more linkage drive cranks actuates the one or more linkage arms, thereby actuating the enclosure panel between a stowed configuration and a deployed configuration.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present disclosure will be apparent from the following detailed description of the embodiments and the accompanying drawing figures.

BRIEF DESCRIPTION OF THE DRAWING FIGURES

Embodiments of the present disclosure are described in detail below with reference to the attached drawing figures, wherein.

Figure 1:
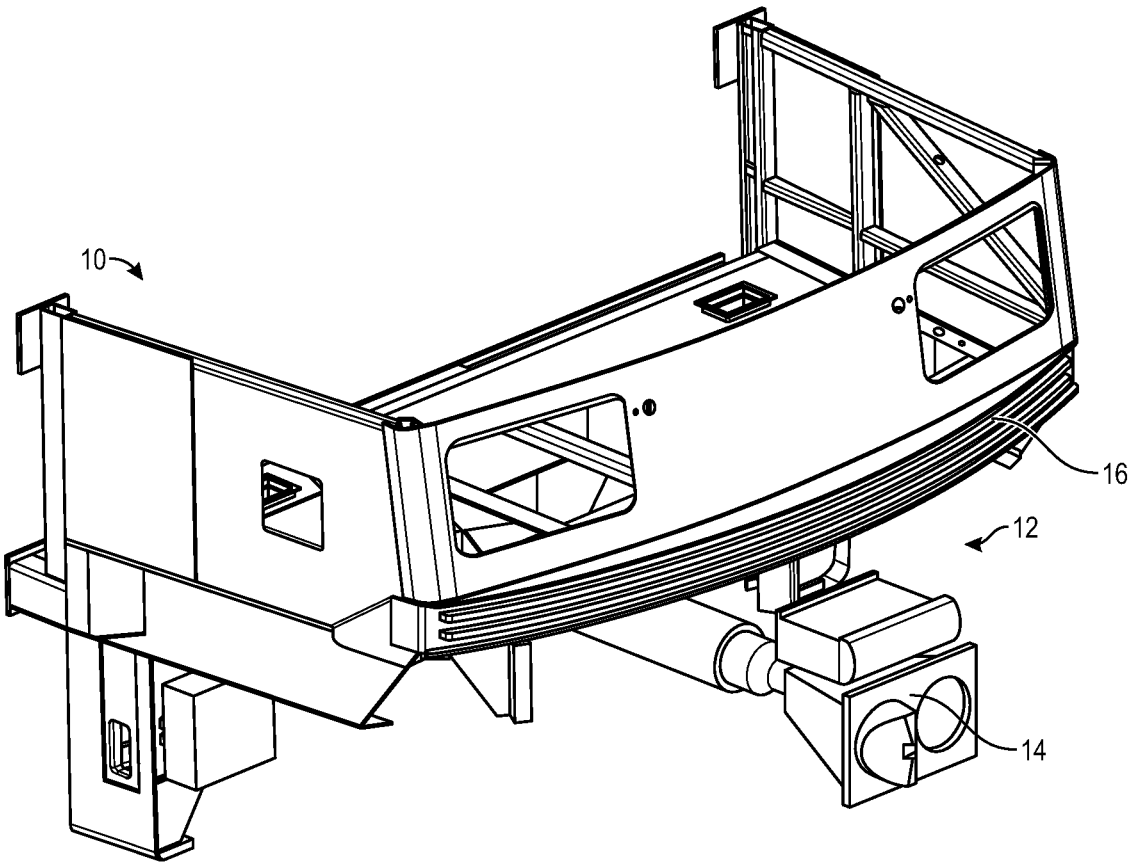
FIG. 1 shows embodiments of a frame of a railway vehicle of prior art.

The drawing figures do not limit the present disclosure to the specific embodiments disclosed and described herein. The drawings are not necessarily to scale, emphasis instead being placed upon clearly illustrating the principles of the present disclosure.

DETAILED DESCRIPTION

The subject matter of the present disclosure is described in detail below to meet statutory requirements; however, the description itself is not intended to limit the scope of claims. Rather, the claimed subject matter might be embodied in other ways to include different steps or combinations of steps similar to the ones described in this document, in conjunction with other present or future technologies. Minor variations from the description below will be understood by one skilled in the art and are intended to be captured within the scope of the claimed disclosure. Terms should not be interpreted as implying any particular ordering of various steps described unless the order of individual steps is explicitly described.

The following detailed description references the accompanying drawings that illustrate specific embodiments in which the present disclosure can be practiced. The embodiments are intended to describe aspects of the present disclosure in sufficient detail to enable those skilled in the art to practice the present disclosure. Other embodiments can be utilized and changes can be made without departing from the scope of the present disclosure. The following detailed description is, therefore, not to be taken in a limiting sense. The scope of the present disclosure is defined only by the appended claims, along with the full scope of equivalents to which such claims are entitled.

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the technology can include a variety of combinations and/or integrations of the embodiments described herein.

Enclosure for Light Rail Vehicles

FIG. 1 depicts a frame 10 of a railway vehicle known in the prior art. As depicted, the frame 10 includes a gap 12 having a coupler 14 extending therefrom and an anticlimber 16 located at the top of the gap 12. Coupler 14 may be configured to couple two cars of a railway vehicle. For example, coupler 14 may attach to another coupler 14 located on a second car (see FIG. 14). Operative attachment of two cars of a railway vehicle via coupler 14 allows for efficient extension or reduction of the size of the railway vehicle. Alternatively, a car of a railway vehicle may be easily detached from the railway vehicle for typical maintenance. Gap 12 is typically included to provide a range of motion for coupler 14. For example, coupler 14 may require a certain range of mobility along both a rotational horizontal plane and a rotational vertical plane, so as, for example, to allow cars of the railway vehicle to attach to one another and travel along a track. For example, while banking along a turn or a hill, the forward car will experience the turn prior to the rear car. In this example, the coupler 14 is pivotable along the horizontal plane so as to allow independent movement of the forward car from the rear car. As such, gap 12 allows coupler 14 to pivot in the aforementioned manner.

Additionally frame 10 of prior art railway vehicles includes an anticlimber 16. Anticlimber 16 is included in frame 10 to mitigate the effects of a crash between two cars of a railway vehicle or between a railway vehicle and a vehicle (such as automobile). For example, upon an impact or a rapid deceleration of a railway vehicle, two cars of the railway vehicle may collide if the force of the deceleration causes the coupler-coupler interaction to break. In such a scenario, anticlimber 16 of each car will come into contact with one another. As such, the anticlimbers 16 partially disperse the force of the collision, thereby mitigating damages done to both cars of the railway vehicle. Accordingly, anticlimber 16 cannot be blocked by any system of the railway vehicle for safety purposes.

Figure 2:
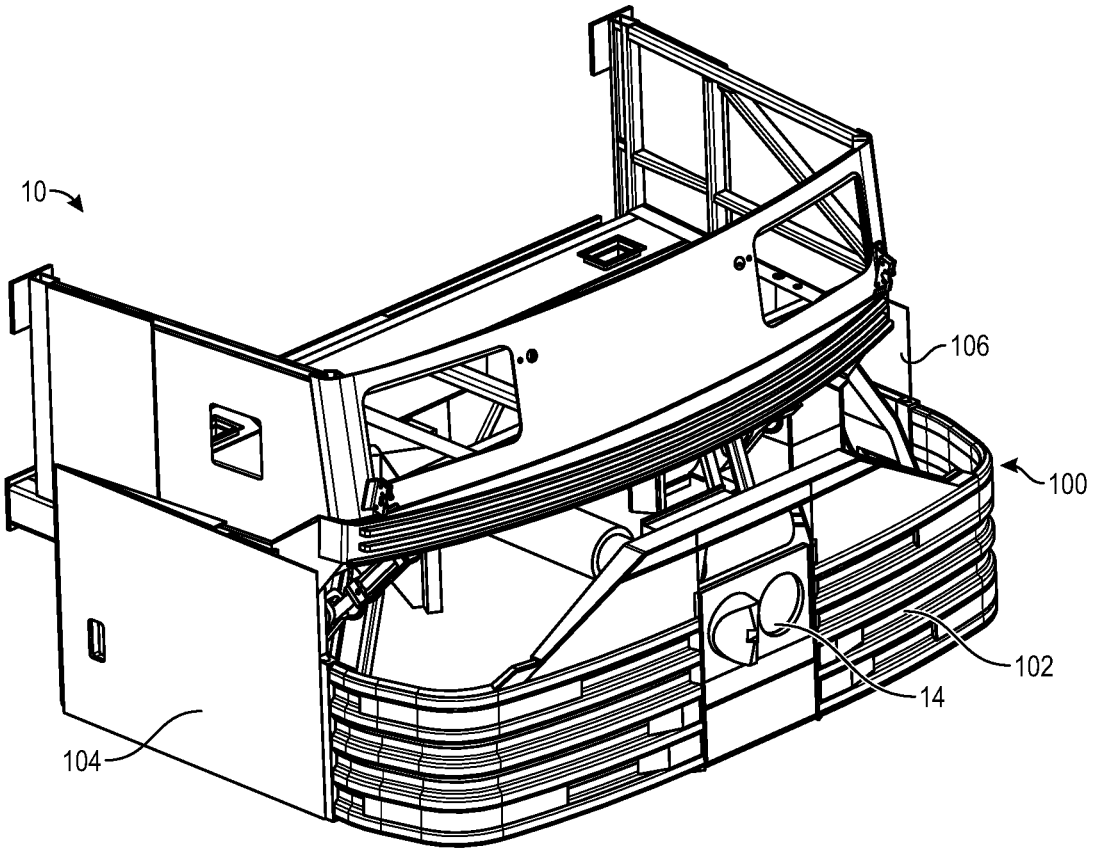
FIG. 2 shows an enclosure system of some embodiments attached to the railway vehicle frame of FIG. 1.
Figure 3:
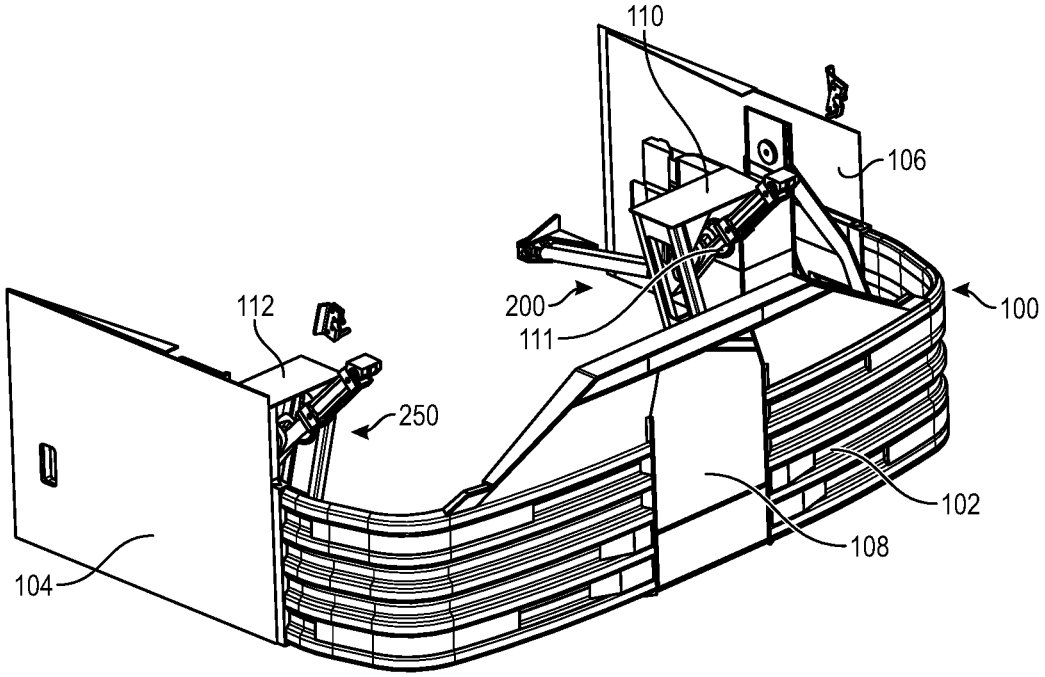
FIG. 3 shows components of the enclosure system of FIG. 2, in some embodiments.

FIG. 2 illustrates an enclosure system 100 of some embodiments attached to the frame 10 of the prior art railway vehicle. FIG. 3 shows the enclosure system 100 and associated components prior to attachment to frame 10, in some embodiments. Accordingly, FIGS. 2 and 3 are best viewed together for the following description. As will be discussed in greater detail below, enclosure system 100 may be configured to attach, fasten, or otherwise secure to railway vehicle frame 10, either as a retrofit or as an OEM configuration. Such a capability is advantageous for multiple reasons: a) it would be very costly to design and build all new cars having an enclosure attached; b) replacing existing railway vehicle cars with new cars would be very time consuming; and c) new railway vehicles would require increased training of personnel running the new railway vehicle. While frame 10 is depicted as one specific design of a frame of a railway vehicle, it is noted that enclosure system 100 may be configured, designed, or otherwise implemented as a retrofit or original equipment manufacture. Embodiments of enclosure system 100 disclosed herein are not limited to frame 10 depicted in FIG. 1 as attachment components of enclosure system 100 may be configured to fit many different frame types of railway vehicles. As such, enclosure system 100 is versatile in that it may be applied to many different railway vehicles currently in use.

In embodiments, enclosure system 100 includes an enclosure panel 102; first and second side panel 104, 106 configured to break away from enclosure system 100 in response to a collision; a coupler centering assembly 108 mounted in or coupled with enclosure panel 102; first and second linkage mounts 110, 112 configured to allow for enclosure system 100 to be retrofitted to a railway vehicle frame; and first and second actuating mechanisms 200, 250 for transitioning enclosure system 100 between a deployed configuration and a stowed configuration.

In some embodiments, lateral sides of enclosure panel 102 may engage the first side panel 104 and the second side panel 106. In some embodiments, enclosure panel 102 may comprise a flat shape with the lateral sides roughly perpendicular to the first and second side panels 104, 106 (not shown). In some embodiments, as depicted in FIGS. 2-3, the lateral sides of enclosure panel 102 may be curved around frame 10 of the railway vehicle. As will be discussed in greater detail below, first side panel 104 and second side panel 106 may be configured to break away from enclosure system 100 and frame 10 upon a collision, thereby dispersing some collision forces.

Figure 17:
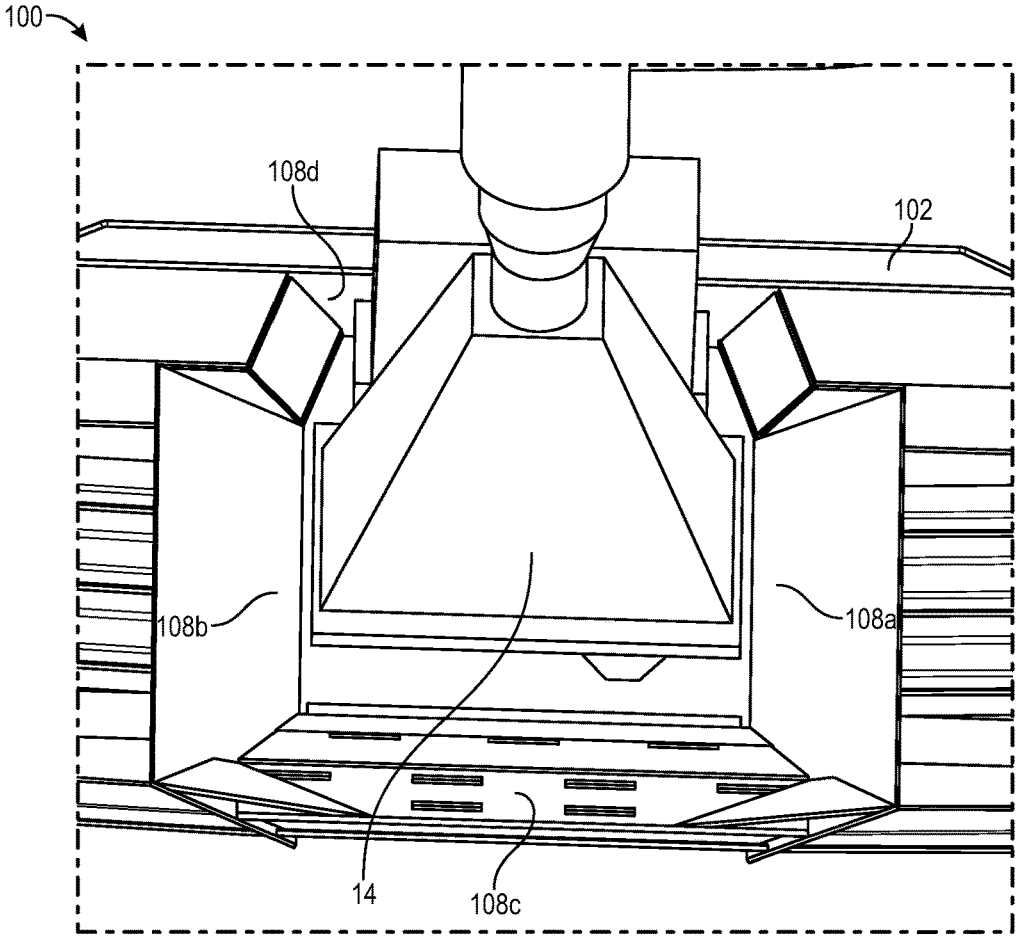
FIG. 17 shows a coupler centering assembly of the enclosure system, in some embodiments.

Coupler centering assembly 108 formed in or mounted to enclosure panel 102 may be configured to engage coupler 14, for example by receiving a portion of coupler 14, when enclosure system 100 is in a deployed configuration, as depicted in FIG. 2. As will be discussed in greater detail below, coupler 14 may be adjustable along horizontal and/or vertical planes. Accordingly, inner portions of coupler centering assembly 108 are configured to redirect the end of coupler 14 such that it extends into and through coupler centering assembly 108 (e.g., see FIG. 17).

In embodiments, enclosure system 100 further includes one or more actuating mechanisms 200, 250 for transitioning enclosure system 100 between a deployed configuration and a stowed configuration. More or fewer actuating mechanisms similar to those described herein may be used to transition enclosure system 100 between the deployed and stowed configurations. First and second actuating mechanisms 200, 250 will be further discussed below with reference to FIGS. 4-14.

Actuating Mechanism to Deploy or Stow Enclosure

As noted above, enclosure system 100 is configured to transition between a deployed configuration and a stowed configuration. Such capabilities advantageously allow for coupling of a railway vehicle car to another railway vehicle car when in the stowed configuration and deployment of enclosure system 100 when at least one side of the railway vehicle car is exposed (i.e., not coupled to another railway vehicle car). To transition from the deployed configuration (e.g., FIG. 7) to the stowed configuration (e.g., FIG. 11), enclosure panel 102 and associated components may be actively lifted. Enclosure panel 102 may be made of a stiff, strong material that is designed to absorb and/or transfer the force of a collision. Actuating mechanisms 200, 250 may aid in or otherwise place the enclosure system 100 in a stowed configuration. Furthermore, while transitioning enclosure system 100 from the stowed configuration (e.g., FIG. 11) to the deployed configuration (e.g., FIG. 7), resistive forces may be used to prevent enclosure panel 102 and associated components from aggressively "slamming" down in the deployed configuration. For example, if enclosure system 100 were released from the stowed configuration without any resistive forces, the enclosure panel 102 and associated components may break or become damaged. Below is a description of some embodiments of actuating mechanisms (e.g., first actuating mechanism 200) that aid in lifting components of enclosure system 100 into the stowed configuration as well as preventing components of enclosure system 100 from "slamming" down into the deployed configuration.

Figure 4:
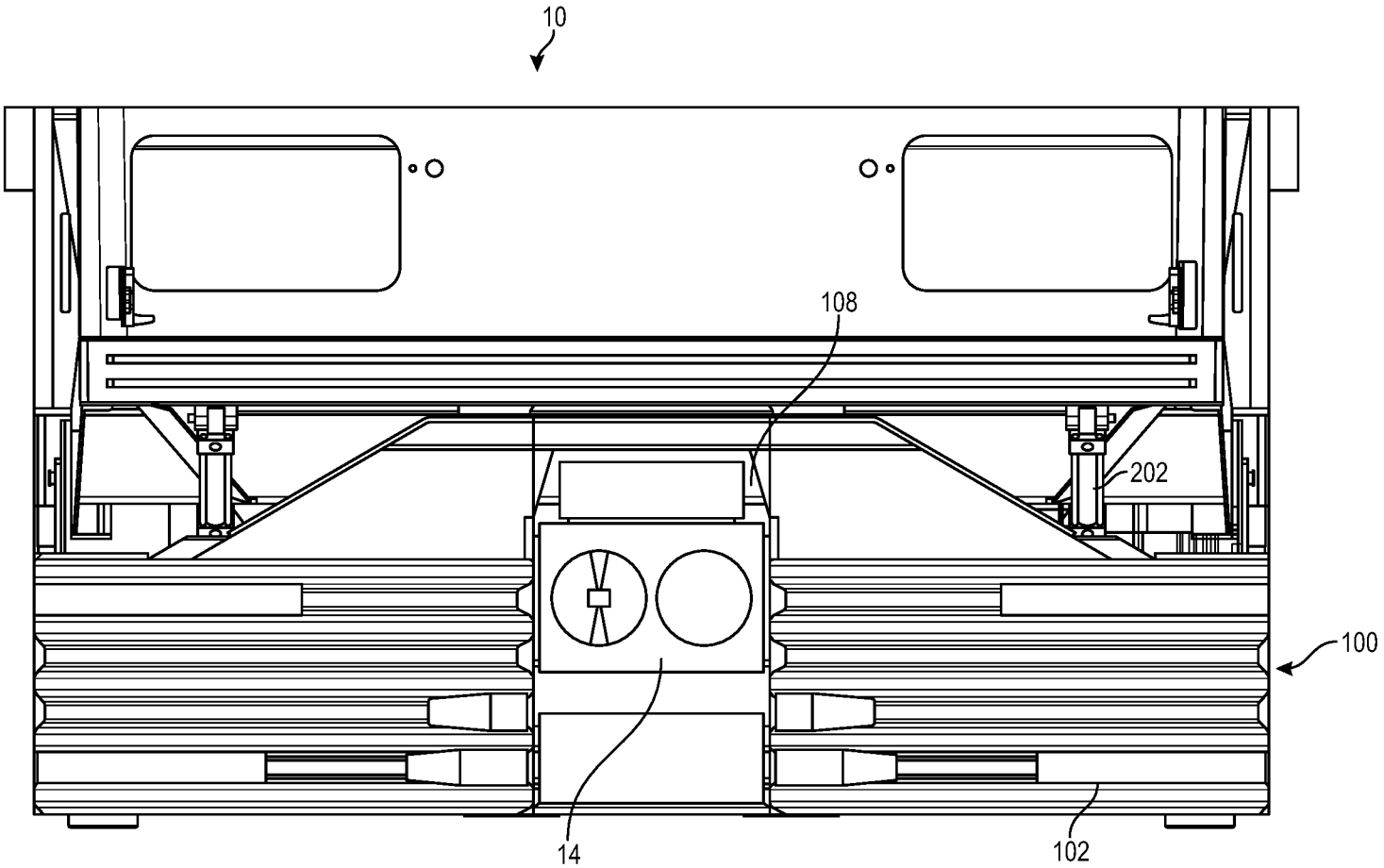
FIG. 4 shows a front view of the enclosure system of some embodiments in a deployed position.
Figure 5:
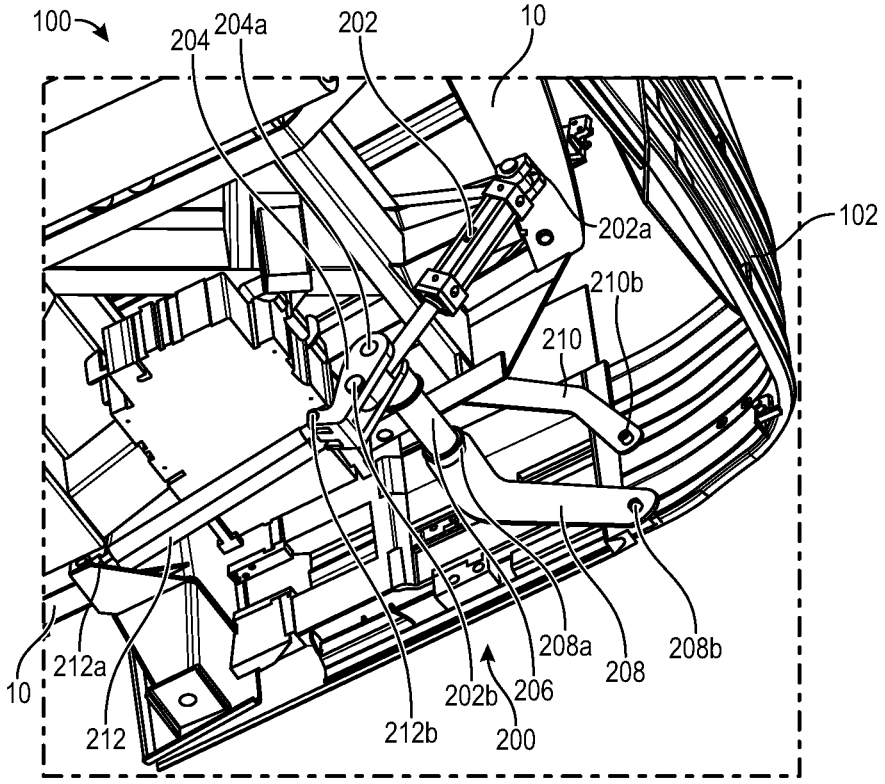
FIG. 5 shows a perspective bottom view of the enclosure system of some embodiments in the deployed position.
Figure 6:
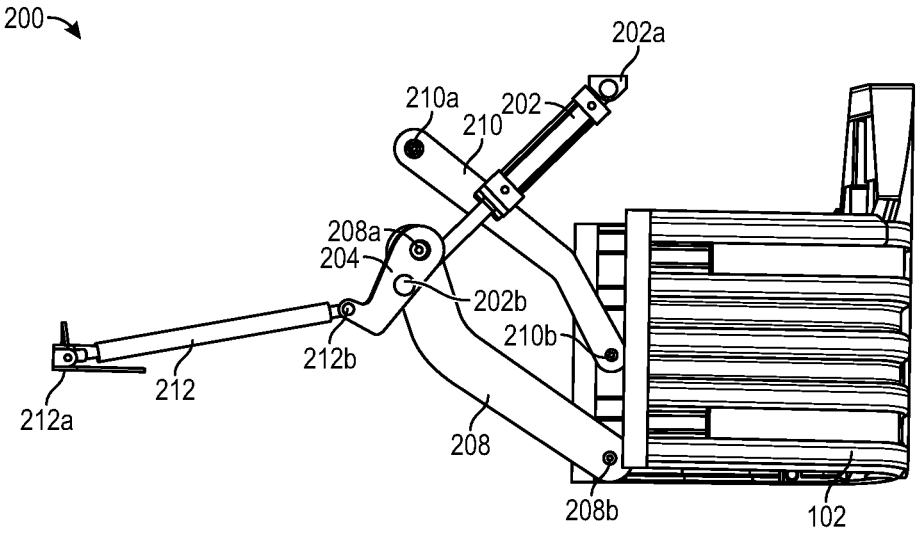
FIG. 6 shows a side view of some components of an enclosure actuating mechanism in the deployed position, in some embodiments.
Figure 7:
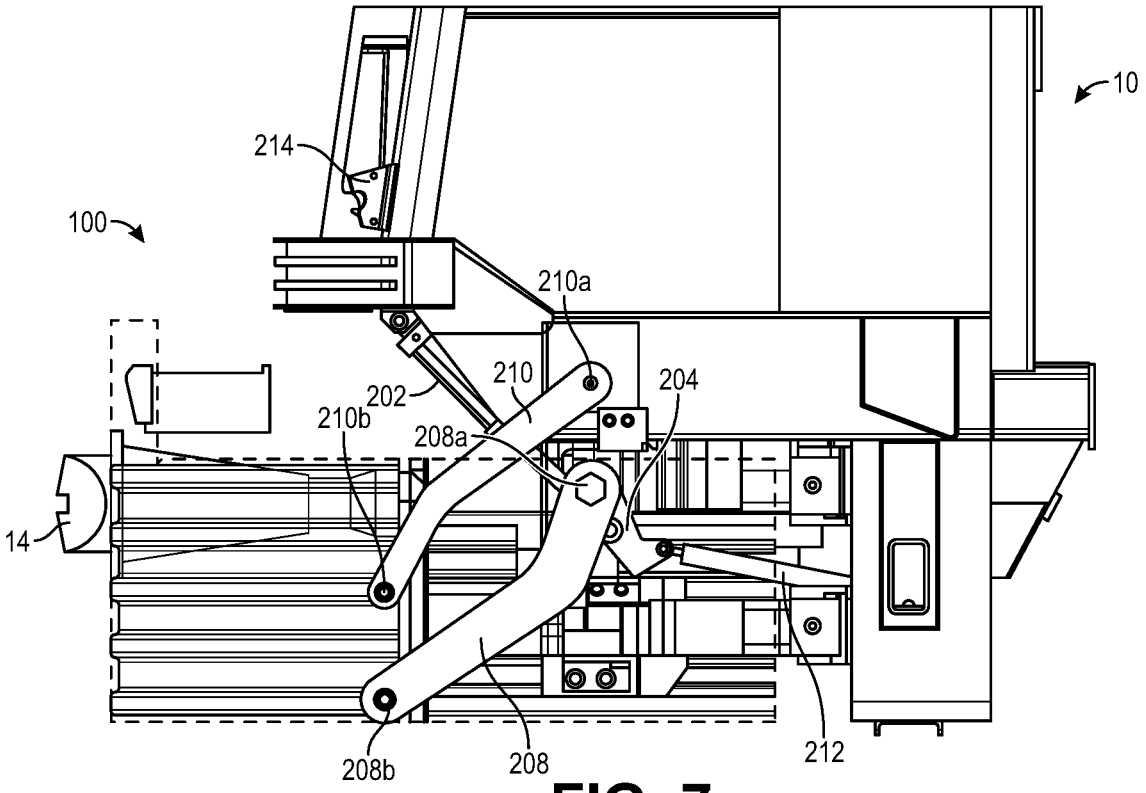
FIG. 7 shows a side view of the enclosure system in the deployed position, with some components hidden for viewing the enclosure actuating mechanism, in some embodiments.

FIG. 4 depicts some embodiments of a front view of enclosure system 100 in the deployed configuration. FIG. 5 depicts a perspective bottom view of enclosure system 100 in the deployed configuration. FIG. 6 depicts a side view of some components of actuating mechanism 200 in the deployed position, in some embodiments. FIG. 7 depicts a side view of some embodiments of enclosure system 100 in the deployed configuration, with some components hidden. As FIGS. 4-7 depict enclosure system 100 in the deployed configuration, they are best viewed together for the following description.

As illustrated, enclosure system 100 is configured to cover, partially or fully, gap 12 when in the deployed configuration. As mentioned above, enclosure system 100 may include one or more actuating mechanisms (e.g., first actuating mechanism 200, second actuating mechanism 250, etc.). For purposes of clarity, the following description will focus on first actuating mechanism 200. However, it is to be understood that the description may apply to second actuating mechanism 250 or additional actuating mechanisms not depicted herein.

First actuating mechanism 200, in some embodiments, includes actuating cylinder 202. As will be discussed in greater detail below, actuating cylinder 202 may be configured to actuate components of enclosure system 100 into the upward, stowed configuration. Accordingly, actuating cylinder 202 may comprise any of a gas strut, a spring strut, or a hydraulic cylinder. Actuating cylinder 202 may be attached to a static point (e.g., frame 10, anticlimber 16, or a mounting block otherwise attached to frame 10 or anticlimber 16) at a first end 202*a*. As such, first end 202*a* may provide for a static structure by which actuating cylinder 202 may impose force on components of enclosure system 100. As illustrated in FIGS. 5-6, actuating cylinder 202 may be in an extended state when enclosure system 100 is in a deployed state. As mentioned above, actuating cylinder 202 may be configured to exert force when directed towards a compressed state. As such, actuating cylinder 202 may act to "pull" components of enclosure system 100 into the stowed configuration.

In some embodiments, first actuating mechanism 200 further includes a biasing member 212. Biasing member 212 may be configured to bias components of enclosure system 100 in the stowed configuration. Accordingly, biasing member 212 may comprise a spring, spring strut, a gas strut, or a hydraulic damper. In some embodiments, biasing member 212 may be attached at a first end 212*a* to frame 10, first linkage mount 110, or a mounting block otherwise attached to frame 10. Accordingly, first end 212*a* provides a static point by which biasing member 212 may press against. As shown in FIGS. 5-6, biasing member 212 is in the compressed state when enclosure panel 102 is deployed. Accordingly, when fully compressed, biasing member 212 may be acting to prevent further downward movement of components of enclosure system 100.

In some embodiments, biasing member 212 may aid a user in transitioning enclosure system 100 from the deployed configuration to the stowed configuration. For example, in case of a power outage in which actuating cylinder 202 is unable to stow enclosure panel 102, biasing member 212 may bias enclosure panel 102 towards the stowed configuration, but unable to solely stow enclosure panel 102. Accordingly, a user may lift enclosure panel 102 while being aided by biasing member 212 into the stowed configuration. In some embodiments, actuating cylinder 202 may be controllable via a controller located within a compartment of the LRV frame 10. For example, an operator of the railway vehicle may, via the controller, command actuating cylinder 202 in a specific position (e.g., to the compressed state).

As depicted, both actuating cylinder 202 and biasing member 212 may be operatively connected to a linkage drive crank 204. For example, actuating cylinder 202 may be connected to linkage drive crank 204 at a second end 202*b* and biasing member 212 may be connected to linkage drive crank 204 at a second end 212*b*. As best illustrated in FIG. 5, linkage drive crank 204 may further be connected to a first linkage arm 208 via extending member 206. Extending member 206 may be mechanically linked to linkage drive crank 204 by any commonly known method. For example, extending member 206 may be received by and mechanically coupled to linkage drive crank 204 via welding, fasteners, chemical adhesive, etc. Furthermore, the connection between extending member 206 and linkage drive crank 204 may be configured to efficiently transfer rotational force between one another. For example, in some embodiments extending member 206 may include a square nut or hex nut extending into a pivot point 204*a* of linkage drive crank 204. As such, as linkage drive crank 204 is rotated about pivot point 204*a* (e.g., via actuation by one or both of actuating cylinder 202 and/or biasing member 212), this will cause rotation of extending member 206. In some embodiments, extending member 206 is mechanically coupled to first linkage arm 208 at a first end 208*a*. Further, first linkage arm 208 may be mechanically coupled to enclosure panel 102 at a second end 208*b*. Accordingly, rotational force exerted on first linkage arm 208 around first end 208*a* may actuate enclosure panel 102 (e.g., towards a stowed state).

In some embodiments, enclosure system 100 may further include a second linkage arm 210 mechanically coupled to enclosure panel 102. In some embodiments, second linkage arm 210 may be mechanically coupled to frame 10 and/or first linkage mount 110 at a first end 210*a* and connected to enclosure panel 102 at a second end 210*b*. In some embodiments, second linkage arm 210 may be configured to aid in the movement of enclosure panel 102 between the deployed configuration (e.g., FIG. 7) and the stowed configuration (e.g., FIG. 11). In some embodiments, second linkage arm 210 may passively aid in the movement of enclosure panel 102 between the deployed and stowed configurations. While not depicted here, in some embodiments second linkage arm 210 may be actively driven to aid in the transition of enclosure panel 102 between the deployed and stowed configurations. For example, in some embodiments second linkage arm 210 may be driven by similar mechanisms disclosed herein for driving rotation of first linkage arm 208. In some embodiments, second linkage arm 210 may comprise passive mechanisms or components configured to bias second linkage arm 210 towards the stowed configuration. For example, second linkage arm 210 may comprise a torsional elastic member (e.g., a torsional spring) that biases second linkage arm 210 around first end 210*a* and towards a stowed configuration (e.g., FIG. 11). In another example, second linkage arm 210 may be connected, directly or indirectly, to biasing member 212 such that it passively acts on a portion of second linkage arm 210 thereby biasing it towards the stowed configuration.

In some embodiments, rotation of first linkage arm 208 may actuate enclosure system 100 towards the stowed configuration. For example, actuating cylinder 202 may exert force upon first linkage arm 208, thereby causing it to rotate about pivot point 204*a*. For example, as illustrated in FIG. 6, actuating cylinder 202 may be mechanically coupled to linkage drive crank 204 at a second end 202*b*. Second end 202*b*, in some embodiments, is located lower on linkage drive crank 204 than pivot point 204*a*. When actuated, actuating cylinder 202 may be biased towards a compressed state (e.g., FIG. 10). Accordingly, while compressing, actuating cylinder 202 may cause linkage drive crank 204 to rotate (e.g., in a counterclockwise direction) around pivot point 204*a*. As described above, rotation of linkage drive crank 204 is transferred to extending member 206 and first linkage arm 208. Accordingly, first linkage arm 208 is rotated about first end 208*a* while simultaneously actuating enclosure panel 102 at second end 208*b* in the upwards (i.e., stowed) direction.

In some embodiments, biasing member 212 may be configured to augment the rotational forces exerted on linkage drive crank 204 when actuating cylinder 202 is driven towards a compressed state. For example, biasing member 212 may be connected to linkage drive crank 204 at second end 212*b*, which is located below pivot point 204*a*. In some embodiments, as depicted, second end 212*b* is located below second end 202*b*. In yet other embodiments, second end 212*b* may be located above second end 202*b* but still below pivot point 204*a*. In yet other embodiments not depicted herein, second end 202*b* may be attached to linkage drive crank 204 above pivot point 204*a* while second end 212*b* is attached to linkage drive crank 204 below pivot point 204*a*. In these embodiments, actuating cylinder 202 may be driven to an extended state to rotate linkage drive crank 204 about pivot point 204*a* while biasing member 212 is also biased in an extended state. Accordingly, as actuating cylinder 202 is actuating linkage drive crank 204 about pivot point 204*a*, biasing member 212 may augment the rotation of linkage drive crank 204, thereby assisting in rotation of first linkage arm 208 and thus lifting enclosure panel 102 towards the stowed configuration.

In some embodiments, enclosure panel 102 may be prevented from extending past the deployed configuration (i.e., downwards) via multiple aspects of enclosure system 100. For example, biasing member 212 may be compressible only up to a certain distance. Accordingly, rotation of linkage drive crank 204 may be halted upon compression of biasing member 212 to this threshold compressible distance. In another example, actuating cylinder 202 may be extendable only a certain distance. Accordingly, rotation of linkage drive crank 204 may be halted upon extension of linkage drive crank 204 to this threshold extendable distance. In another example, portions of enclosure panel 102, such as groove 150 may come into stable contact with breakaway panel 302 (e.g., see FIGS. 15-16). As contact between enclosure panel 102 and breakaway panel 302 is stable, breakaway panel 302 may prohibit further downward movement of enclosure panel 102 past the deployed configuration. Any one or combination of the above examples may retain enclosure panel 102 in the deployed configuration.

Figure 8:
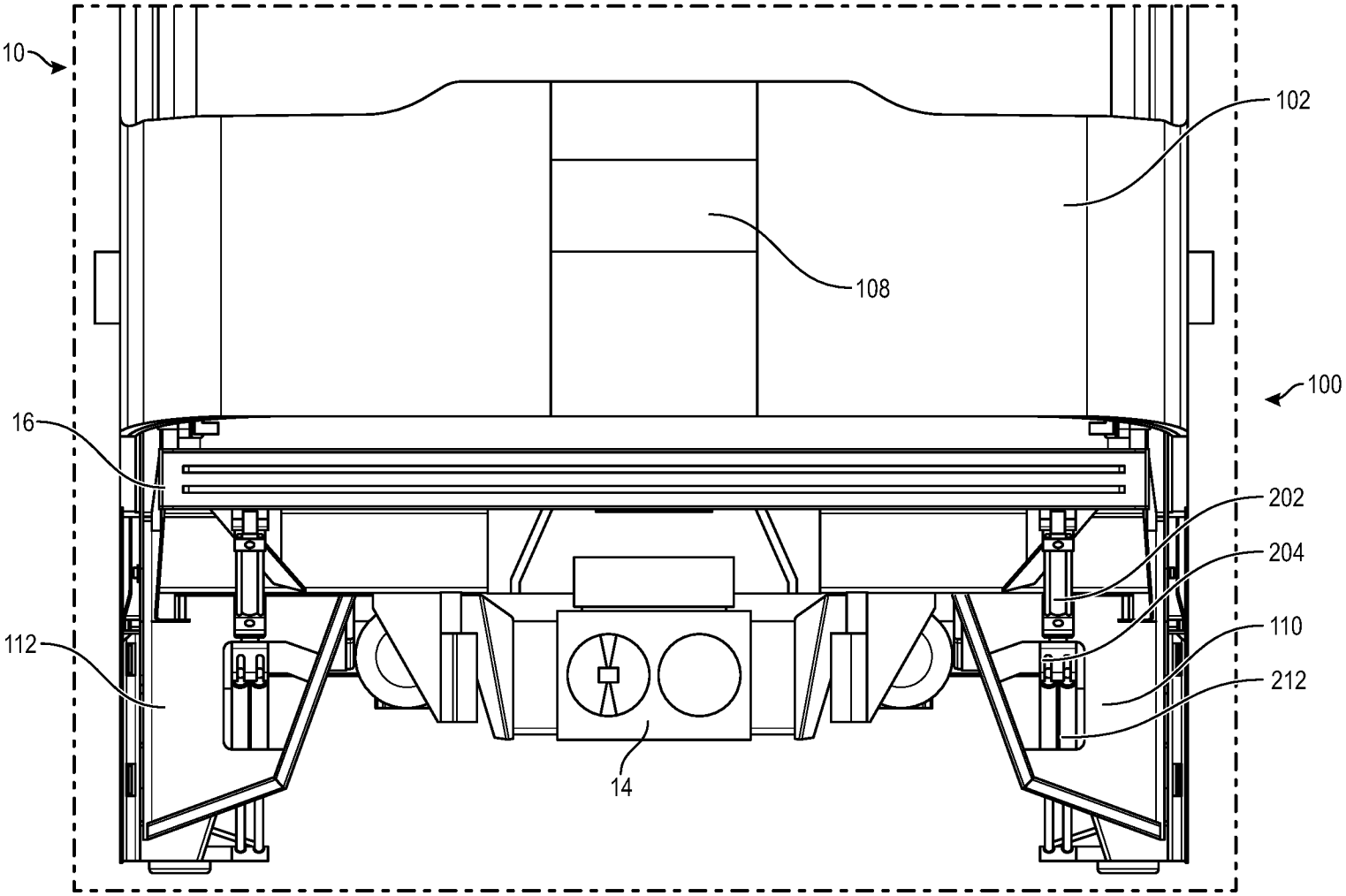
FIG. 8 shows a front view of the enclosure system of some embodiments in a stowed position.
Figure 9:
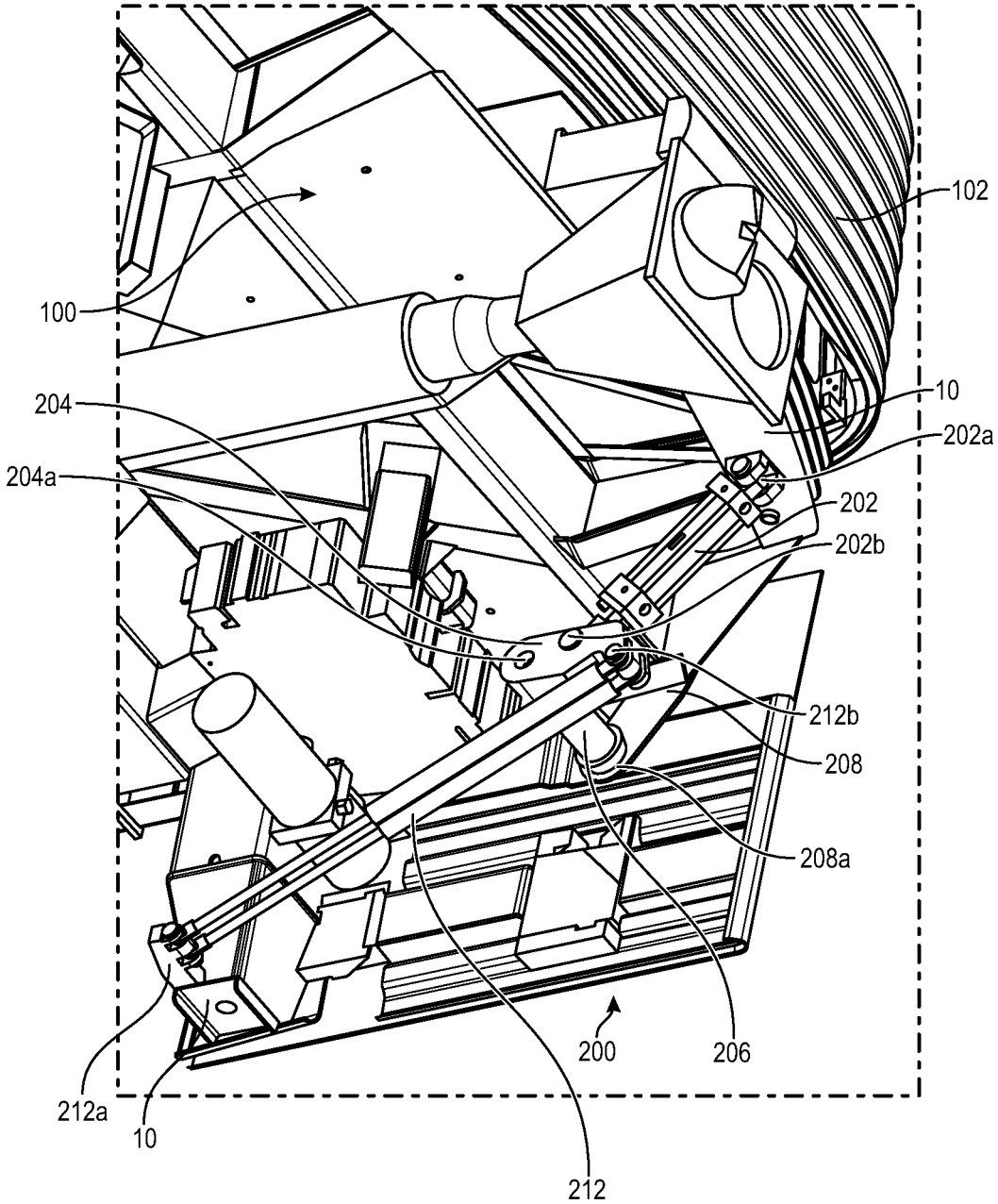
FIG. 9 shows a perspective bottom view of the enclosure system of some embodiments in the stowed position.
Figure 10:
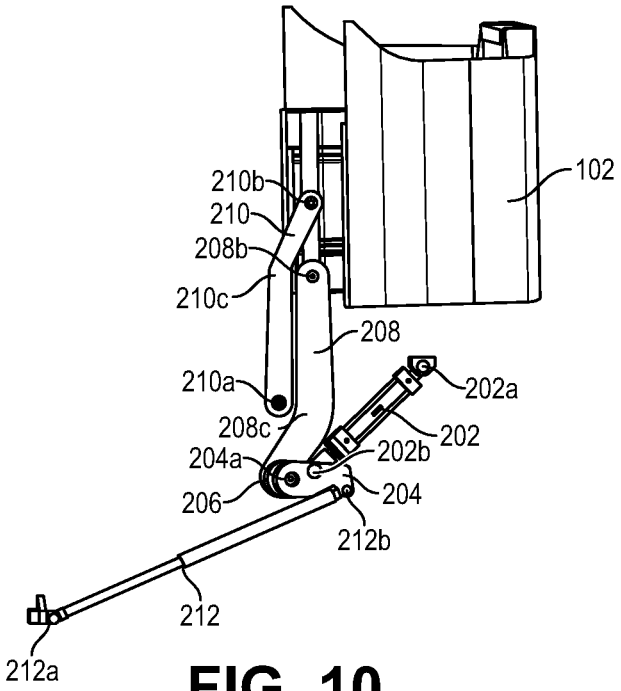
FIG. 10 shows a side view of some components of the enclosure actuating mechanism in the stowed position, in some embodiments.
Figure 11:
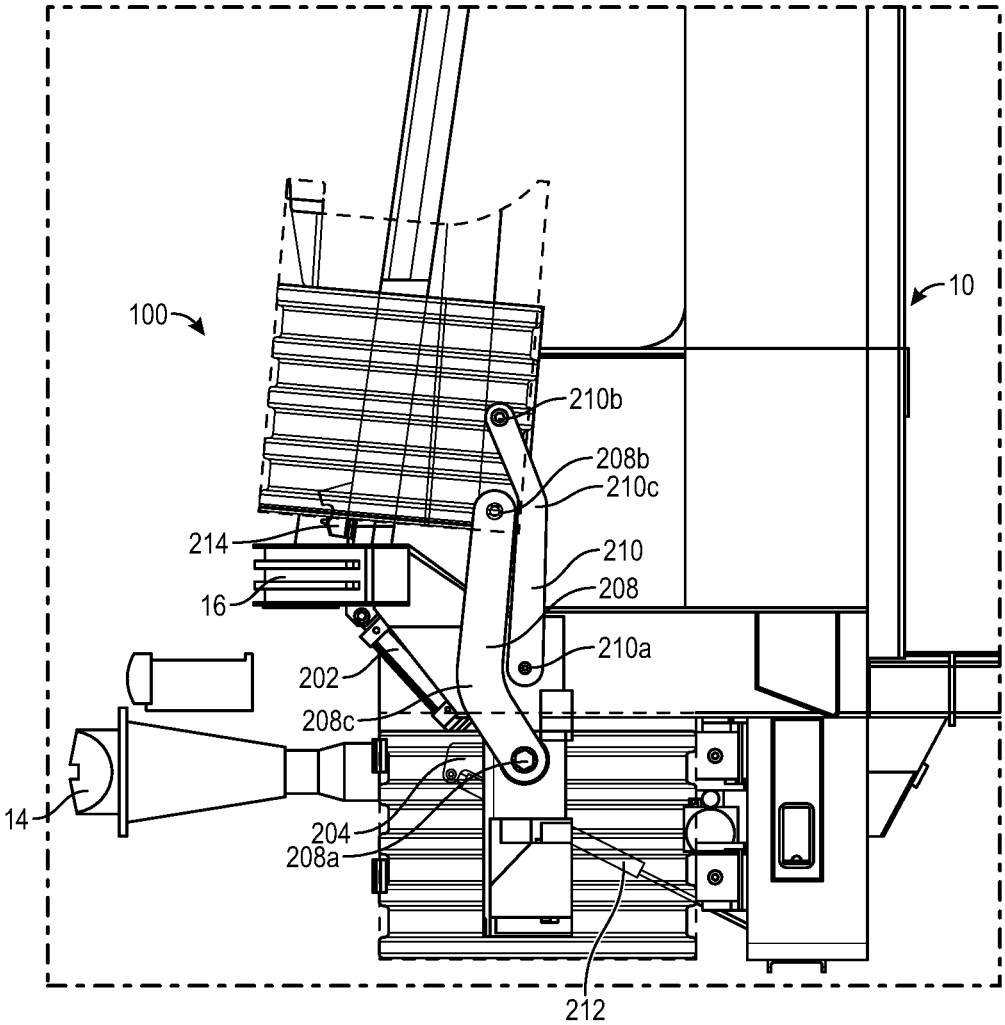
FIG. 11 shows a side view of the enclosure system in the stowed position, with some components hidden for viewing the enclosure actuating mechanism, in some embodiments.

FIG. 8 depicts some embodiments of a front view of enclosure system 100 in the stowed configuration. FIG. 9 depicts some embodiments of a perspective bottom view of enclosure system 100 in the stowed configuration. FIG. 10 depicts a side view of some components of actuating mechanism 200 in the stowed position, in some embodiments. FIG. 11 depicts a side view of some embodiments of enclosure system 100 in the stowed configuration, with some components hidden. As FIGS. 8-11 depict enclosure system 100 in the stowed configuration, they are best viewed together for the following description.

As described above, rotational force exerted on linkage drive crank 204 is translated to extending member 206 and first linkage arm 208 via mechanical connection of these components. First linkage mount 110 is removed from view in FIGS. 5-6, and 9-10 to allow for viewing of some components of first actuating mechanism 200. In some embodiments, first linkage mount 110 includes a receiving hole 111 (e.g., see FIG. 3) for receiving some or all of extending member 206. In these embodiments, receiving hole 111 defined within first linkage mount 110 may be configured to support extending member 206. For example, the diameter of receiving hole 111 may be slightly larger than the diameter of the widest portion of extending member 206. Accordingly, the weight bearing load placed on extending member 206 when enclosure panel 102 transitions between the deployed and stowed configurations may be partially or mostly transferred from extending member 206 to first linkage mount 110 via receiving hole 111. In some embodiments in which extending member 206 is received within receiving hole 111, there may be one or more bearings placed therein to aid in rotation of extending member 206. For example, one or more bearings may be placed on one or both of extending member 206 and/or receiving hole 111 to allow for seamless rotation of extending member 206 when enclosure panel 102 transitions between the deployed and stowed configurations.

Figure 14:
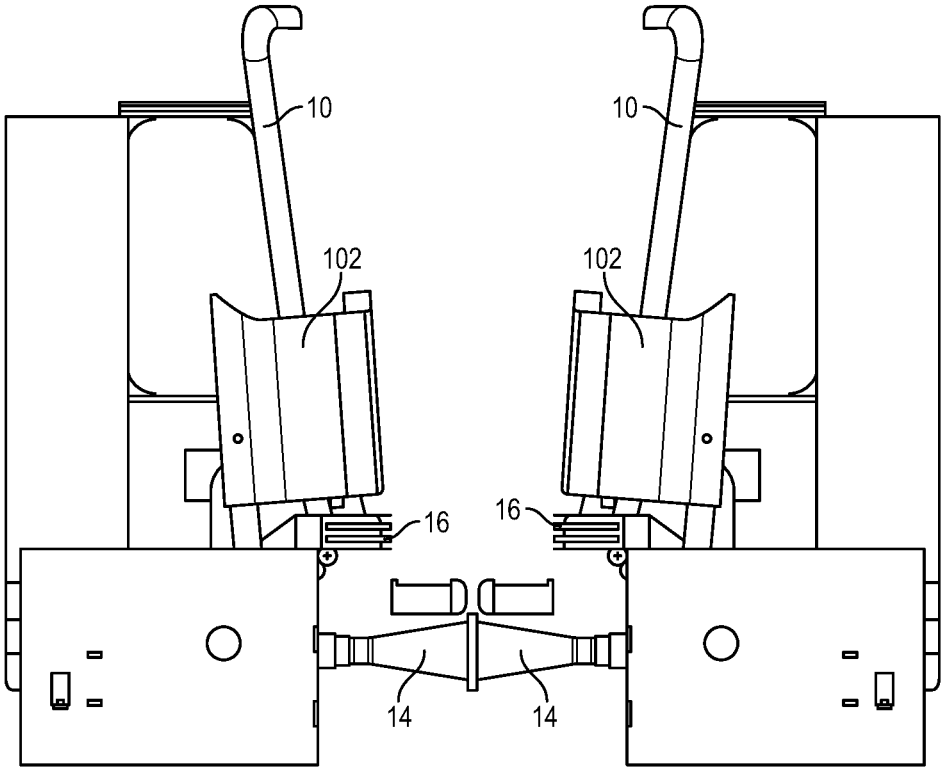
FIG. 14 shows some embodiments of a first and second railway vehicle coupled while respective enclosure systems are in the stowed position.

As illustrated in FIG. 8, when enclosure panel 102 is in the stowed configuration, both coupler 14 and anticlimber 16 are exposed. As shown in FIG. 14, placing the enclosure panel 102 in the stowed configuration allows for the railway vehicle car to be coupled to another railway vehicle car via coupler 14. Additionally, in the case of a collision, anticlimber 16 is exposed between the intervening railway vehicle cars thereby being configured to absorb any impact between the railway vehicle cars. Furthermore, when enclosure panel 102 is in the stowed configuration, the line of sight of an operator of the railway vehicle is not obstructed.

In some embodiments, due to vibrations of enclosure panel 102 in the stowed state, padding (e.g., high durometer rubber) may be added to portions of frame 10 to prevent damage or noise from enclosure panel 102 vibrating against frame 10. Further, such padding may prevent longitudinal and/or lateral movement of enclosure panel 102 when in the stowed configuration by contact between the padding and an internal side of enclosure panel 102. In some embodiments, padding may additionally or alternatively be added to the internal side of enclosure panel 102 and configured to contact portions of frame 10 when enclosure panel 102 is in the stowed configuration. Similarly, padding located on the internal side of enclosure panel 102 may prevent damage, noise, and/or movement of enclosure panel 102 when in the stowed configuration. For example, due to traveling speeds of the railway vehicle (e.g., 40 mph) or windy weather conditions, a significant wind load may be placed on enclosure panel 102 while in the stowed configuration. As such, placement of padding on the internal side of enclosure panel 102 and/or frame 10 may prevent movement of enclosure panel 102 when experiencing such wind loads.

In some embodiments, other stabilizing mechanisms may be used to prevent longitudinal or lateral movement of enclosure panel 102 while in the stowed configuration. For example, magnets may be placed on frame 10 and the internal side of enclosure panel 102 such that when enclosure panel 102 is in the stowed configuration, the magnets act in a repulsive manner. Strength of the magnets may be configured or chosen such that the repulsive forces do not prevent stowing of enclosure panel 102 but enough that enclosure panel 102 is prevented from movement due to wind load, or other vibrational forces exerted on enclosure panel 102 when stowed. In some embodiments, magnets described above may be oriented such that the magnets act in an attractive manner when enclosure panel 102 is in the stowed configuration. Such a configuration may also prevent movement of enclosure panel 102 when in the stowed configuration. In these embodiments, strength of the magnets may be configured or chosen such that the attractive forces are strong enough to prevent movement of enclosure panel 102 when in the stowed configuration, but do not prevent enclosure panel 102 from transitioning from the stowed configuration to the deployed configuration.

As illustrated in FIGS. 10-11, first linkage arm 208 and second linkage arm 210 may be configured to be substantially flush when in the stowed configuration. For example, in some embodiments first linkage arm 208 may comprise an angled portion 208*c*. Angled portion 208*c* may be configured to prevent first linkage arm 208 from contacting second linkage arm 210 when enclosure system 100 is in the stowed configuration. Similarly, in some embodiments second linkage arm 210 may comprise an angled portion 210*c*. Angled portion 210*c* may be configured to prevent second linkage arm 210 from contacting first linkage arm 208 when enclosure system 100 is in the stowed configuration. In some embodiments, angled portion 208*c* may be angled in the opposite direction as angled portion 210*c*. For example, as illustrated in FIG. 7, angled portion 208*c* is configured such that second end 208*b* is angled clockwise from first end 208*a* while angled portion 210*c* is configured such that second end 210*b* is angled counterclockwise from first end 210*a*. In some embodiments, second end 208*b* is connected to enclosure panel 102 on a lower horizontal plane than where first end 208*a* is connected to frame 10 or first linkage mount 110. In further embodiments, second end 210*b* is connected to enclosure panel 102 on a lower horizontal plane than where first end 210*a* is connected to frame 10 or first linkage mount 110.

In some embodiments, angled portions 208*c*, 210*c* are configured to allow for first end 208*a* of first linkage arm 208 and first end 210*a* of second linkage arm 210 to be attached to frame 10 and/or first linkage mount 110 along substantially the same vertical plane. For example, first end 208*a* may be attached to frame 10 and/or first linkage mount 110 directly vertical to the attachment point of first end 210*a*. Accordingly, without angled portions 208*c*, 210*c*, first linkage arm 208 and second linkage arm 210 would not be able to actuate enclosure panel 102 to a fully stowed configuration without contacting one another. Additionally, angled portions 208*c*, 210*c* and/or placement of first ends 208*a*, 210*a*, and second ends 208*b*, 210*b*, may be configured to cause an oblong path of enclosure panel 102 when transitioning between the deployed and stowed configurations. For example, FIG. 7 shows some embodiments in which coupler 14 has a portion that protrudes through enclosure panel 102 at coupler centering assembly 108. Accordingly, enclosure panel 102 is unable to rotate in a substantially circular path between the deployed and stowed configurations. Therefore, the location and geometry of first linkage arm 208 and second linkage arm 210 are specific such that enclosure panel 102 will move in a slightly outwards direction to pass coupler 14 and then upwards towards the stowed configuration. Similarly, when moving from the stowed configuration to the deployed configuration, enclosure panel 102 will move downwards and slightly outwards to receive a portion of coupler 14 before rotating slightly inwards towards the fully deployed configuration.

Figure 13:
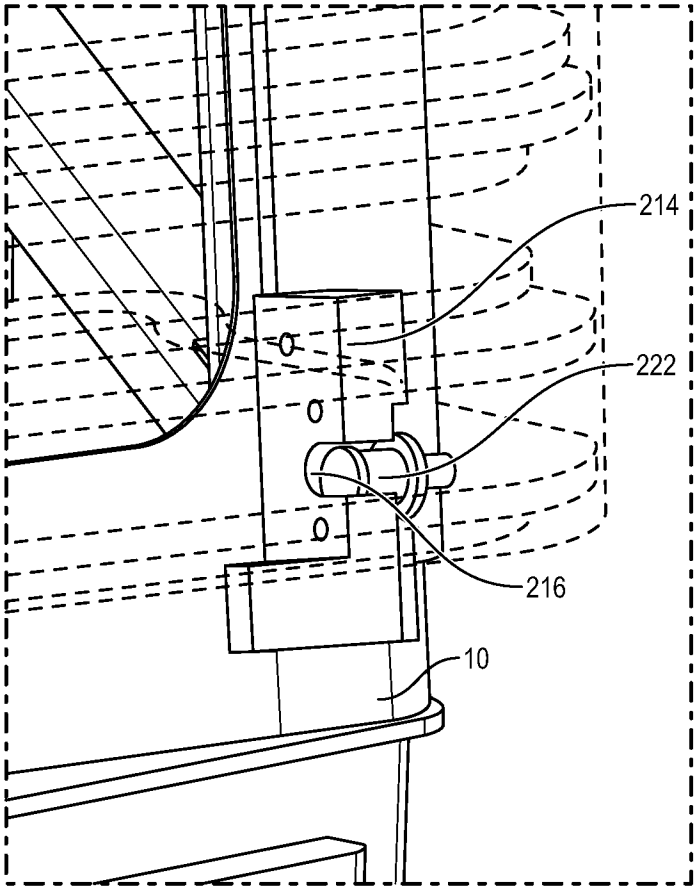
FIG. 13 shows the locking system in a second configuration when the enclosure system is in the stowed position, in some embodiments, with some components hidden from view.
Figure 12:
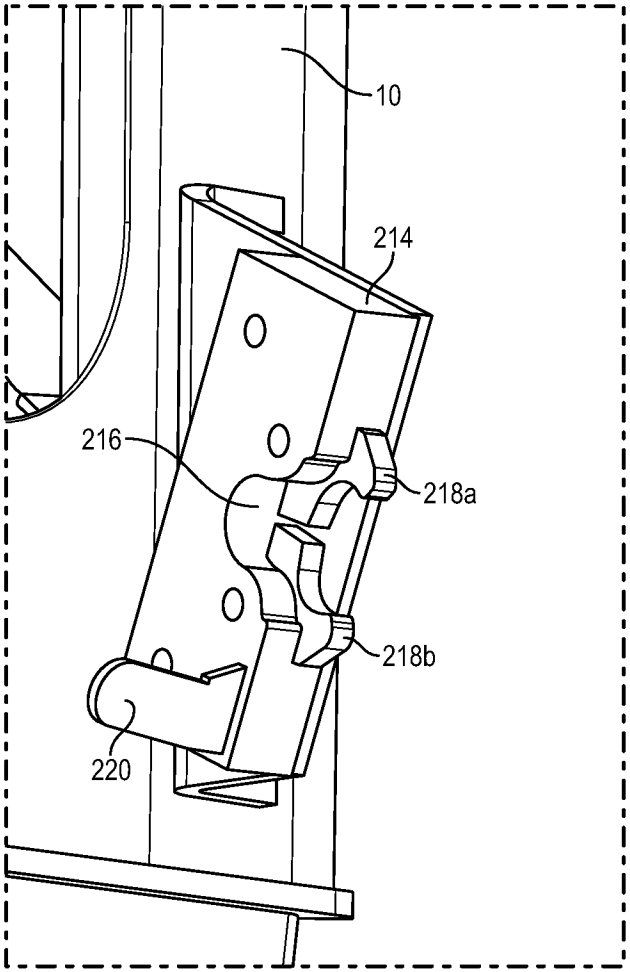
FIG. 12 shows a locking system in a first configuration when the enclosure system is in the deployed position, in some embodiments.

In some embodiments, enclosure system 100 may include a locking system configured to secure, fasten, or otherwise maintain enclosure panel 102 in a stowed configuration. For example, FIG. 12 depicts some embodiments of a receiving mechanism 214 of the locking system. FIG. 13 depicts some embodiments of the receiving mechanism 214 securing a pin 222 located on enclosure panel 102. As illustrated in FIG. 12, receiving mechanism 214 may include a reception indent 216 that includes one or more catches (e.g., catches 218*a*, 218*b*). In some embodiments, catches 218*a*, 218*b* may be configured to receive and subsequently secure pin 222 within the reception indent 216 (i.e., FIG. 13). In some embodiments, receiving mechanism 214 may be retrofitted to frame 10 via commonly known means of fastening. For example, receiving mechanism 214 may be bolted, screwed, adhered, welded, etc. to frame 10 to allow for securing enclosure panel 102 in the stowed configuration. Receiving mechanism 214 may further include release lever 220 configured to mechanically release pin 222 from receiving mechanism 214, thereby allowing enclosure system 100 to transition from the stowed configuration to the deployed configuration. In some embodiments, release of pin 222 from receiving mechanism may be performed physically via an operator actuating release lever 220. In some embodiments, release of pin 222 from receiving mechanism 214 may be performed via a controller. For example, a controller may be electrically or wirelessly coupled to receiving mechanism 214, thereby allowing for a command signal to be received at receiving mechanism 214 to release pin 222.

In some embodiments not depicted herein, the locking mechanism for maintaining enclosure panel 102 in the stowed configuration may be magnetic. For example, magnets may be placed on the internal side of enclosure panel 102 and the exterior of frame 10 such that the magnets are aligned when enclosure panel 102 is placed in the stowed configuration. These magnets may be configured to be attractive, thereby locking enclosure panel 102 in the stowed configuration when in proximity with one another. In these embodiments, the attractive magnetic forces need be overcome (e.g., via actuating cylinder 202) to transition enclosure panel 102 from the stowed configuration to the deployed configuration. In some embodiments, the magnets may be adjustable to regulate when an attractive force is exerted. For example, one or more pairs of magnets located on enclosure panel 102 and/or frame 10 may be rotatable such that upon rotation in a specified direction the poles of the magnets are aligned such that they are attractive. In another example, the magnets may be electromagnetic, such that they are controlled by an electrical current. Accordingly, the magnets may be automatically or mechanically "turned on" to generate attractive forces and thereby lock enclosure panel 102 in the stowed configuration. In the above examples, control of the magnetic forces may be automatic (e.g., by a controller receiving information indicative of enclosure panel 102 transitioning into the stowed configuration), or manual (e.g., by an operator using a switch, button, or other mechanism to control the magnets).

It is envisioned that the locking system disclosed herein may be located at alternative locations throughout frame 10 and enclosure system 100. For example, receiving mechanism 214 may be disposed on any static portion of frame 10 that may subsequently receive pin 222 located on any portion of enclosure system 100 that moves into close proximity to frame 10 when in the stowed configuration.

Coupler Centering Assembly

Figure 15:
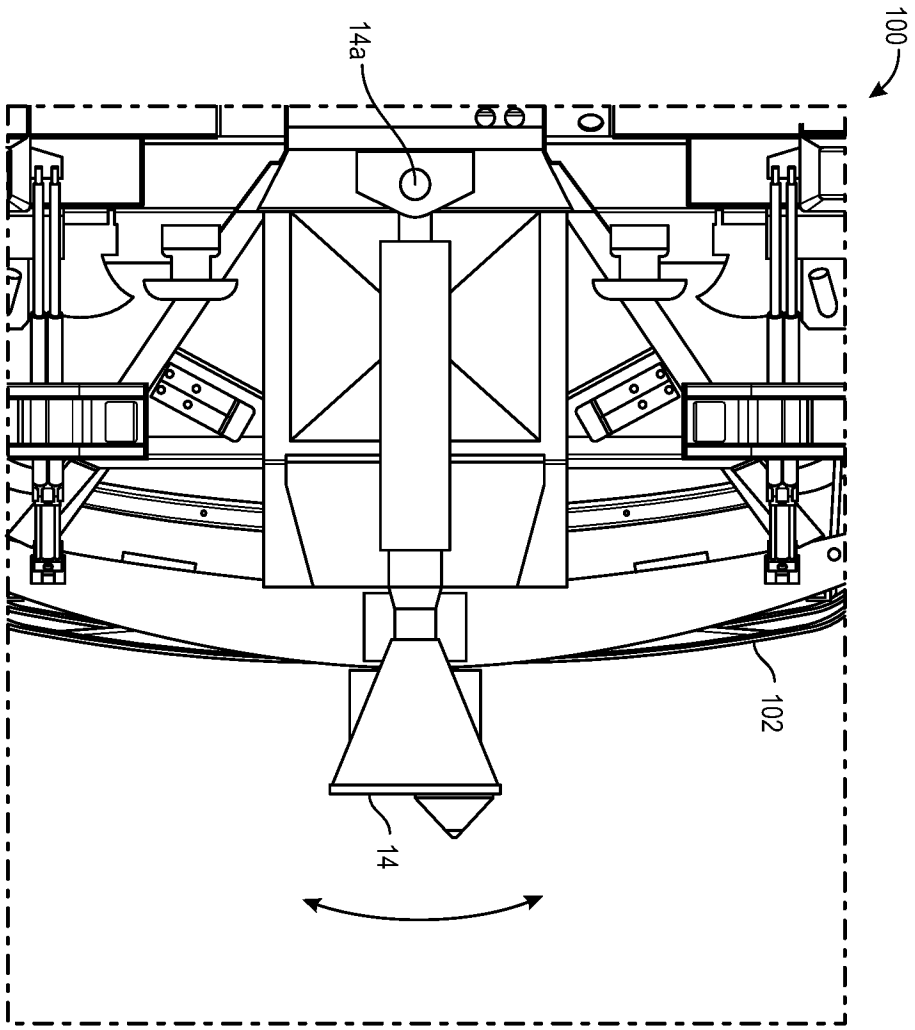
FIG. 15 shows a bottom view of the enclosure system in the stowed position, in some embodiments.
Figure 16:
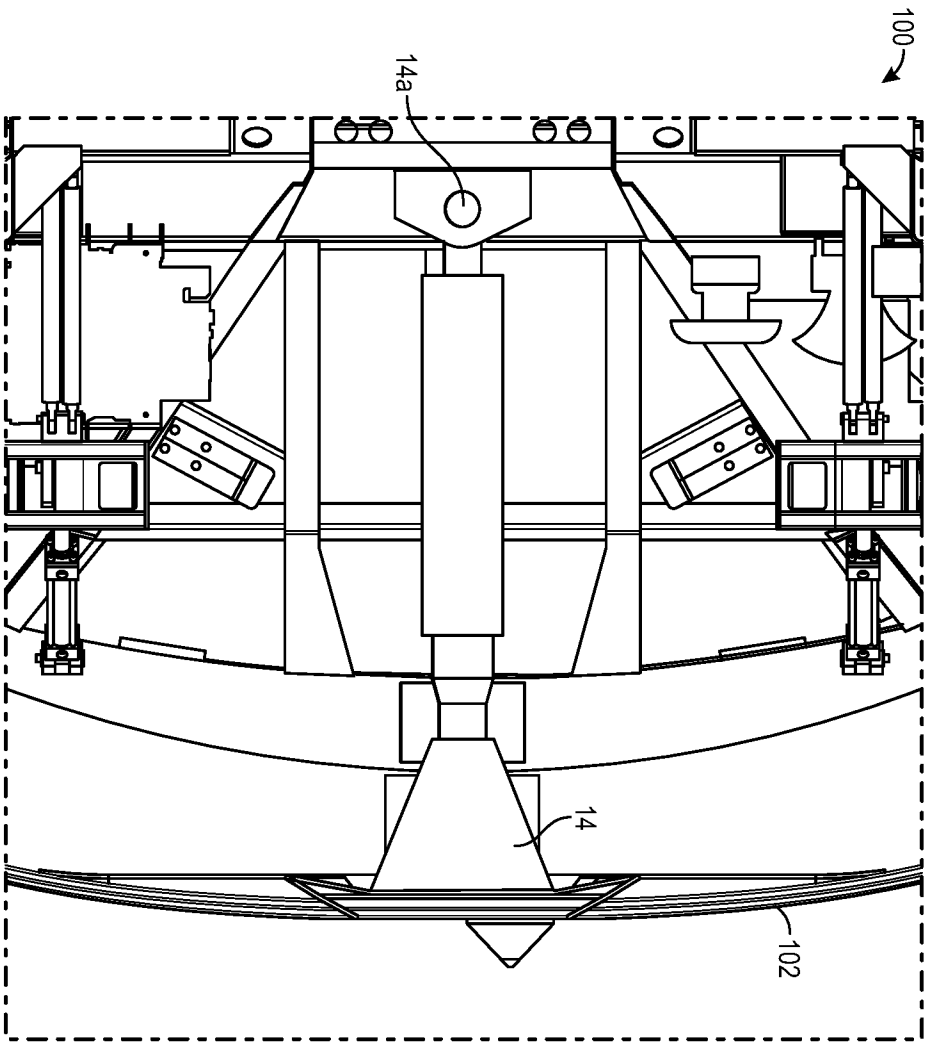
FIG. 16 shows a bottom view of the enclosure system in the deployed position, in some embodiments.

As mentioned above, enclosure system 100 may, in some embodiments, be required to receive and subsequently maintain coupler 14 extending from frame 10. FIG. 15 depicts some embodiments of a bottom view of coupler 14 with enclosure panel 102 in the stowed configuration. As illustrated, coupler 14 may be rotatable along a horizontal plane from coupler pivot point 14*a*. Additionally, not shown here, coupler 14 may be adjustable along a vertical plane. Freedom of movement of coupler 14 is required in scenarios in which a railway vehicle car is coupled to another railway vehicle car via coupler 14 (e.g., see FIG. 14). In these scenarios, the railway vehicle car in the fore position will experience different angles of movement along a track compared to the railway vehicle car in the aft position. Accordingly, the connection between the two railway vehicle cars, via coupler 14, must be somewhat flexible. However, in the case that the railway vehicle car is not connected to another railway vehicle car, coupler 14 may serve to absorb substantial amounts of force in the case of a collision. For example, coupler 14 may include internal components (e.g., an elastomeric spring) configured to absorb a portion of the collision forces. For coupler 14 to properly absorb such collision forces, it is desirably directed and maintained in a forward direction (e.g., as depicted in FIG. 16). Coupler centering assembly 108 is configured to direct and maintain coupler 14 in a mostly forward direction, as described below.

In some embodiments coupler centering assembly 108 is configured to receive and maintain a portion of coupler 14 when enclosure panel 102 is in the deployed configuration (e.g., see FIG. 16). As discussed previously, as enclosure panel 102 transitions from the stowed configuration to the deployed configuration, portions of enclosure panel 102 extend outwardly in rotation so that coupler centering assembly 108 can receive some of coupler 14. In some instances, coupler 14 may not be in a straight position (e.g., as depicted in FIG. 16), but rather at any angle along the arrow illustrated in FIG. 15. Accordingly, portions of coupler centering assembly 108 are configured to bias coupler 14 towards coupler centering assembly 108 as enclosure panel 102 is transitioning into a deployed configuration.

In some embodiments, coupler centering assembly 108 and enclosure panel 102 may include coupler angled sides configured to bias coupler 14 towards coupler centering assembly 108. For example, coupler centering assembly 108 may include horizontal corrals 108*a*, 108*b*, which may bias coupler 14 along the horizontal plane and towards coupler centering assembly 108. In some embodiments, horizontal corrals 108*a*, 108*b* may be at an angle of between about 90 degrees to about 170 degrees with respect to the aft side of the enclosure panel 102 (i.e., the side of enclosure panel 102 contacting coupler 14). In another example, coupler corral may include vertical corrals 108*c*, 108*d*, which may bias coupler 14 along the vertical plane and towards coupler centering assembly 108. In some embodiments, vertical corrals 108*c*, 108*d* may be at an angle of between about 90 degrees to about 170 degrees with respect to the aft side of the enclosure panel 102 (i.e., the side of enclosure panel 102 contacting coupler 14). Accordingly, as enclosure panel 102 is moving downwards towards the deployed configuration, if coupler 14 is slightly off center in either the horizontal or vertical directions, horizontal corrals 108*a*, 108*b*, and/or vertical corrals 108*c*, 108*d*, respectively, may bias coupler 14 such that a portion of coupler is received through coupler centering assembly 108 and the coupler 14 is subsequently maintained in a mostly straight state (e.g., as depicted in FIG. 16) while enclosure system 100 is in the deployed configuration.

Breakaway System

In some embodiments, enclosure system 100 may further include breakaway system 300. Breakaway system 300 may be configured to disperse collision forces by releasing certain components of enclosure system 100 upon a substantial impact (e.g., when the railway vehicle having enclosure system 100 is moving faster than 5 mph and impacting another railway vehicle). In some embodiments, breakaway system 300 may be configured to not breakaway from enclosure system 100 upon a low impact collision (e.g., when the railway vehicle having enclosure system 100 is moving about 5 mph or slower and impacting another railway vehicle). Such adaptability of breakaway system 300 between differing collision impacts keeps maintenance for enclosure system 100 low in the event of a low impact collision while dispersing forces as needed in the event of a high impact collision. Additionally, in some embodiments clearance of some components of enclosure system 100 (e.g., breakaway panel 302) allows for other safety systems (e.g., anticlimber 16) to contact one another and aid in dispersion of collision forces. Furthermore, breakaway system 300 prevents frame 10 from being damaged due to the impact force being translated from breakaway panel 302 to frame 10. For example, as will be discussed in greater detail below, collision forces experienced by enclosure panel 102 may be transferred via stable connections to one or more breakaway panels (e.g., breakaway panel 302). In some embodiments, breakaway panel 302 may comprise one or more high strength steel beams connecting portions of breakaway panel 302 (e.g., the top to the bottom).

Under certain amounts of force, breakaway system 300 may allow for breakaway panel 302, along with first side panel 104 in some embodiments, to shear off from enclosure system 100. As such, the breakaway system 300 allows for targeted dispersion of the collision forces initially exerted on enclosure panel 102. Such dispersion may advantageously protect the vehicle, railway vehicle car, or other object that is impacted by enclosure panel 102, but also protect the integrity of frame 10 and portions of enclosure system 100. For purposes of clarity, breakaway system 300 will be discussed herein with reference to one breakaway system 300. However, it is to be understood that enclosure system 100 may comprise two or more breakaway systems 300 configured to absorb and disperse collision forces experienced by enclosure system 100.

Figure 18:
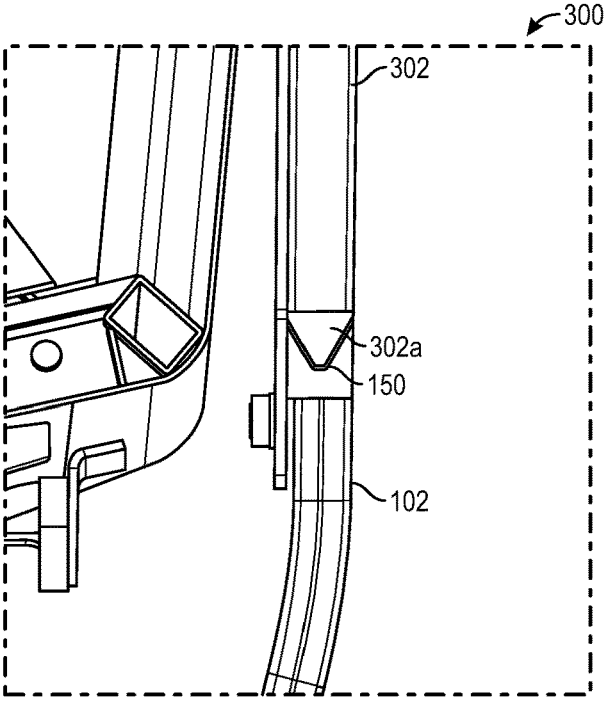
FIG. 18 shows a top view of some embodiments of a breakaway system.
Figure 20:
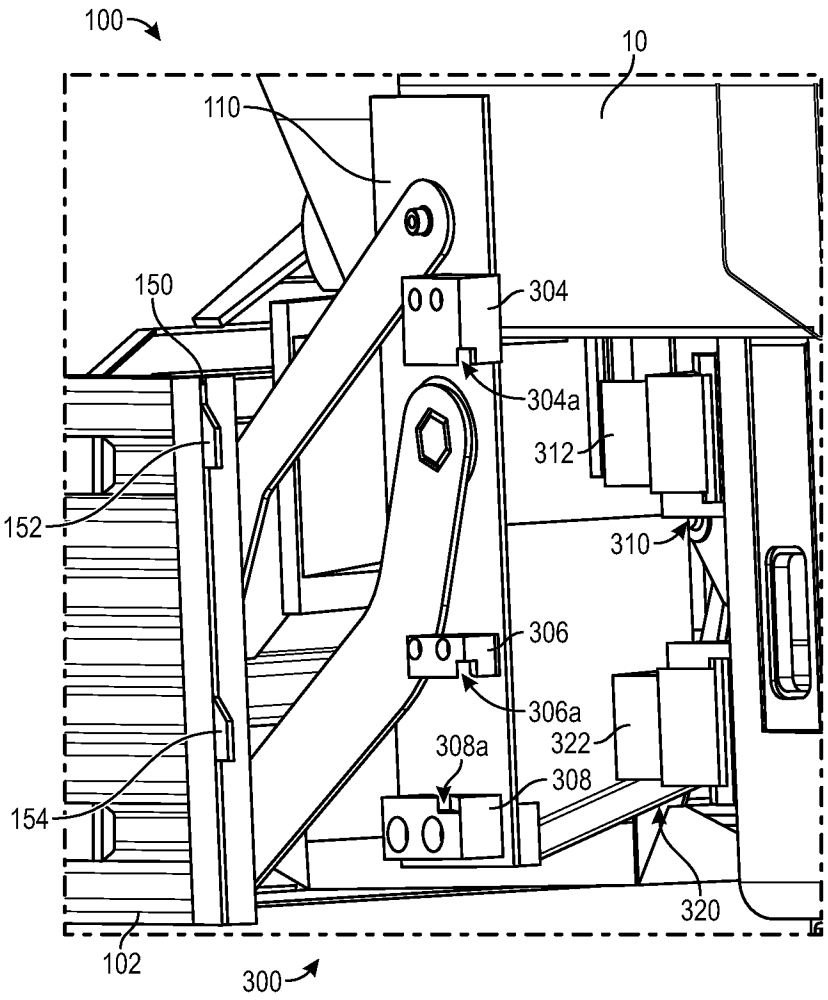
FIG. 20 shows the side panel breakaway mechanism of FIG. 18, in some embodiments, with some components hidden from view.

FIG. 18 depicts a top view of some embodiments of breakaway system 300 with enclosure panel 102 in a deployed configuration. As illustrated in FIG. 18, enclosure panel 102 is configured to securely contact breakaway panel 302 when in the deployed configuration. Further, in some embodiments illustrated in FIG. 18, enclosure panel 102 may include groove 150 that may receive, or substantially abut against ridge 302*a* located on the fore side of breakaway panel 302. The connection between groove 150 and ridge 302*a* forms a stable connection such that in a scenario of a collision, forces are effectively transferred from enclosure panel 102 to breakaway panel 302. Furthermore, in some embodiments depicted in FIG. 20, groove 150 may contain one or more connective extensions (e.g., connective extensions 152 and 154). Connective extensions 152, 154 may be received within slots disposed on breakaway panel 302. As such, connective extensions 152, 154 further form a stable connection between enclosure panel 102 and breakaway panel 302. This stable connection formed between enclosure panel 102 and breakaway panel 302 via groove 150 and connective extensions 152, 154 maintains a stable connection in an angled collision event where the railway vehicle hits an object at an angle other than perpendicular. In some embodiments, connective extensions 152, 154 comprise a geometry that allows for efficient insertion and removal from slots located on breakaway panel 302 when enclosure panel 102 transitions between the deployed configuration and the stowed configuration. For example, as depicted in FIG. 20, connective extensions 152, 154 may be sloped on the top side and flat on the bottom side. Such a geometry allows for enclosure panel 102 to raise up and out of slots located within breakaway panel 302 when transitioning from the deployed to stowed configuration, and for enclosure panel 102 to lower down and into slots located within breakaway panel 302 when transitioning from the stowed configuration to the deployed configuration.

Figure 19:
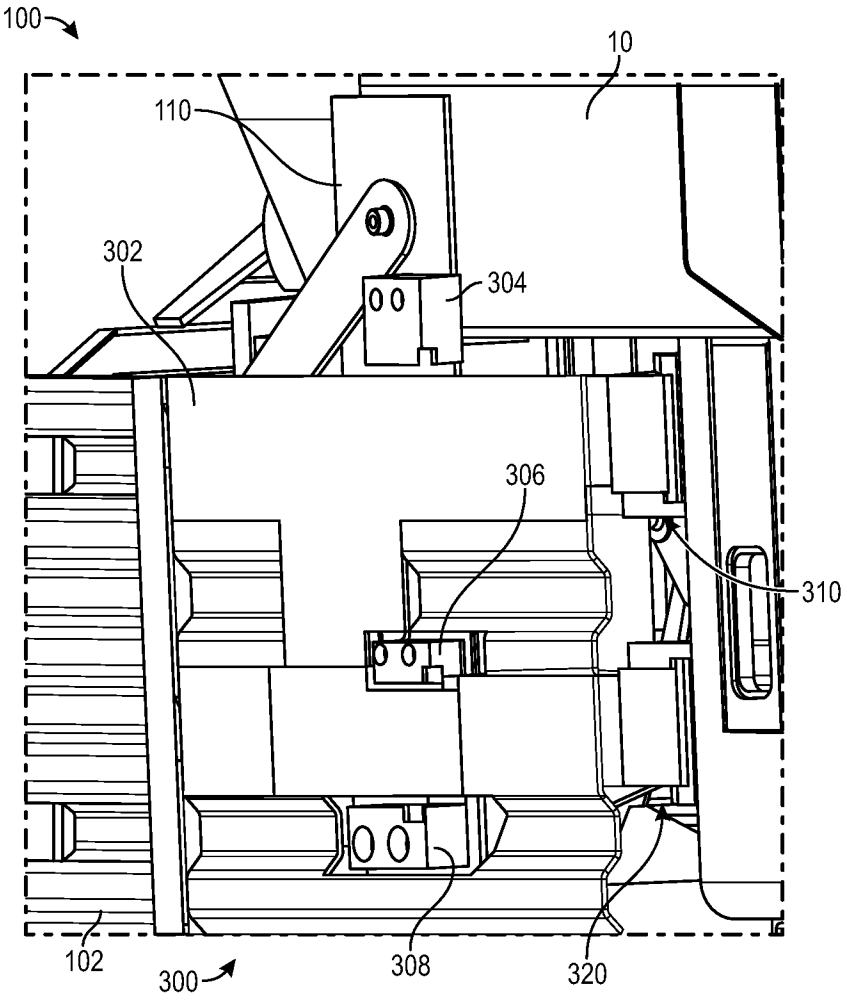
FIG. 19 shows side perspective view of the breakaway system in some embodiments.

FIG. 19 depicts some embodiments of breakaway system 300 with enclosure panel 102 in the deployed configuration. FIG. 20 depicts some embodiments of breakaway system 300 without breakaway panel 302 for viewing some components of breakaway system 300. Accordingly, FIGS. 19-20 are best viewed together for the following description. In some embodiments, breakaway system 300 includes one or more breakaway blocks configured to guide or direct components of breakaway system 300 during the event of a collision. For example, as depicted herein, breakaway system 300 includes a first breakaway block 304, a second breakaway block 306, and a third breakaway block 308. It is to be understood that while three breakaway blocks are depicted here, any number of breakaway blocks may be used to effectively guide portions of breakaway system 300 in the event of a collision. For example, one, two, three, four, five, six, or more breakaway blocks may be used in breakaway system 300. In some embodiments, breakaway blocks 304, 306, 308 may be configured to transiently maintain breakaway panel 302 in place until collision forces are exerted on breakaway panel 302.

As illustrated, in some embodiments first breakaway block 304 includes guide slot 304*a*, second breakaway block 306 includes guide slot 306*a*, and third breakaway block 308 includes guide slot 308*a*. Guide slots 304*a*, 306*a*, 308*a*, may be configured to engage a portion of breakaway panel 302. For example, breakaway panel 302 may include extensions configured to be received within guide slots 304*a*, 306*a*, and 308*a*. Further, guide slots 304*a*, 306*a*, 308*a* may be configured to guide or direct the direction of breakaway panel 302 in the case of a collision and breakaway of breakaway panel 302. For example, as illustrated in FIG. 20, guide slots 304*a*, 306*a*, 308*a* may be directed outwardly from frame 10 and towards the aft direction at an angle greater than 0 degrees and less than 90 degrees. In some embodiments, guide slots 304*a*, 306*a*, 308*a* may be directed outwardly from frame 10 and towards the aft direction at an angle of about 20 degrees to about 50 degrees. Accordingly, when collision forces are transferred from enclosure panel 102 to breakaway panel 302, guide slots 304*a*, 306*a*, 308*a* interacting with breakaway panel 302 may direct breakaway panel 302 outwardly and away from frame 10 as breakaway panel 302 breaks away from enclosure system 100.

In some embodiments, breakaway system 300 includes one or more shear blocks configured to transiently maintain breakaway panel 302 in place until collision forces are exerted on breakaway panel 302. For example, breakaway system 300 may include a first shear block 310 and a second shear block 320. In some embodiments, first shear block 310 and second shear block 320 include connection blocks 312, and 322, respectively. In some embodiments, breakaway panel 302 may include receiving slots configured to receive connection blocks 312, 322. Accordingly, connection blocks 312, 322 provide structural support and force transfer from breakaway panel 302 to first shear block 310 and second shear block 320, respectively.

Figure 22:
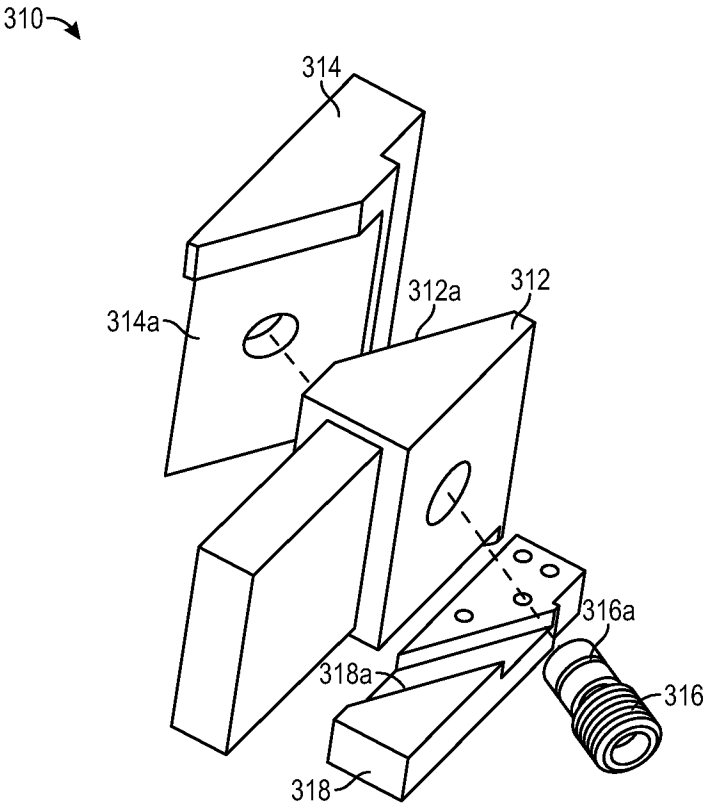
FIG. 22 shows an exploded view of the shearing block of FIG. 21, in some embodiments.
Figure 21:
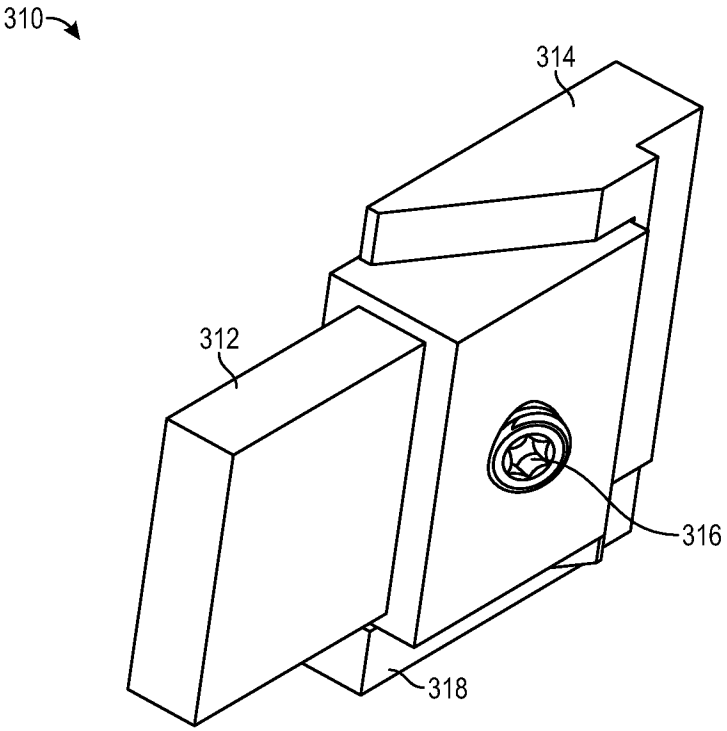
FIG. 21 shows a perspective view of a shearing block of the side panel breakaway mechanism, in some embodiments.

FIG. 21 illustrates some embodiments of first shear block 310 in an assembled state. FIG. 22 illustrates some embodiments of first shear block 310 in an exploded view. Accordingly, FIGS. 21-22 are best viewed together in the following description. As briefly mentioned above, first shear block 310 may be configured to transiently maintain breakaway panel 302 against frame 10 until a sufficient amount of collision force is translated from enclosure panel 102 to breakaway panel 302, and subsequently to first shear block 310. In some embodiments, first shear block 310 includes connection block 312, stationary block 314, set screw 316, and shear guide 318. In some embodiments, set screw 316 is received within and through connection block 312 to fasten connection block 312 to stationary block 314. In some embodiments, set screw 316 includes a shear pin 316*a*. As illustrated, shear pin 316*a* is configured to lie at the intersection between connection block 312 and stationary block 314. In some embodiments, shear pin 316*a* is configured to shear when a sufficient amount of force is exerted on breakaway system 300. For example, when enclosure panel 102 experiences a collision (e.g., with another vehicle), forces exerted on enclosure panel 102 may be transferred to breakaway panel 302. These collision forces are further translated to set screw 316 and shear pin 316*a* as breakaway panel 302 is pressed against connection block 312. In embodiments, shear pin 316*a* is configured to withstand a certain amount of force until shearing. Accordingly, the size and structure of shear pin 316*a* and set screw 316 may be chosen based on the anticipated collision forces. Furthermore, the size and structure of shear pin 316*a* and set screw 316 may be chosen based on the number of shearing blocks used. For example, in embodiments where 4 or more shearing blocks are used, the shear pins may be configured to more easily shear than a shear pin used in embodiments where 1 shearing block is used.

In some embodiments, connection block 312 includes a slanted portion 312*a* configured to abut a stationary slanted portion 314*a* included on stationary block 314. Slanted portion 312*a* and stationary slanted portion 314*a* are configured to guide connection block 312 out and away from frame 10 when shear pin 316*a* is sheared. For example, slanted portion 312*a* and stationary slanted portion 314*a* may be configured at an angle outward from frame 10 and in the aft direction of between about 10 degrees and about 50 degrees. In some embodiments, the angles of guide slots 304*a*, 306*a*, 308*a*, 318*a*, slanted portion 312*a*, and stationary slanted portion 314*a* may be about the same. In some embodiments and as described above, connection block 312 may be mechanically coupled to breakaway panel 302. As such, connection block 312 and breakaway panel 302 may break away from enclosure system 100 as substantially one piece. In some embodiments, shear guide 318 is configured to receive a portion of connection block 312. In some embodiments, stationary block 314 is configured to receive a portion of connection block 312, thereby limiting motion of connection block 312 in the upward direction. Accordingly, stationary block 314 and shear guide 318 prohibit motion of connection block 312 along a vertical plane. Similar to breakaway blocks 304, 306, 308, in some embodiments, shear guide 318 may be configured to guide connection block 312 out and away from frame 10 when collision forces are translated to breakaway panel 302. Accordingly, in some embodiments, connection block 312 is guided in the aft and outward directions from frame 10 when breakaway panel 302 breaks away from enclosure system 100 (i.e., shear pin 316*a* is sheared) due to both stationary slanted portion 314*a* and slanted portion 312*a* sliding along one another as well as shear guide 318 guiding connection block 312 outwards via guide slot 318*a*.

Collision Mitigation

Figure 24:
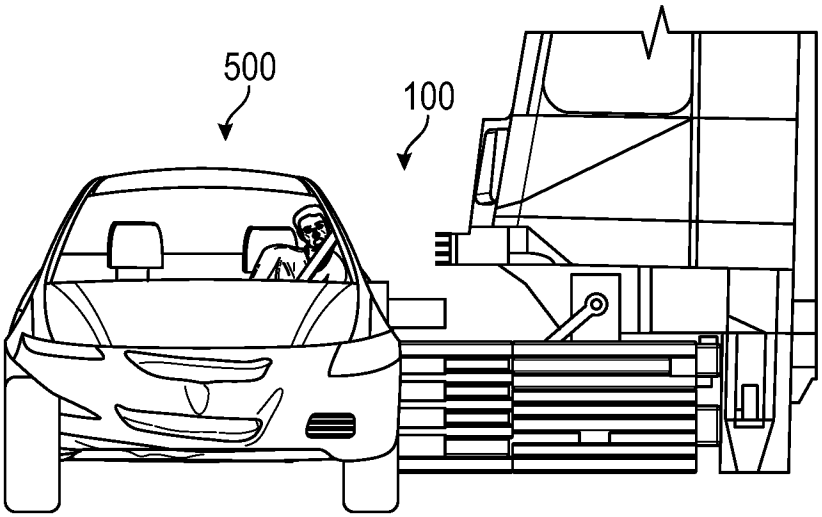
FIG. 24 depicts a collision between the railway vehicle of FIG. 2 having the enclosure system and a car.
Figure 23:
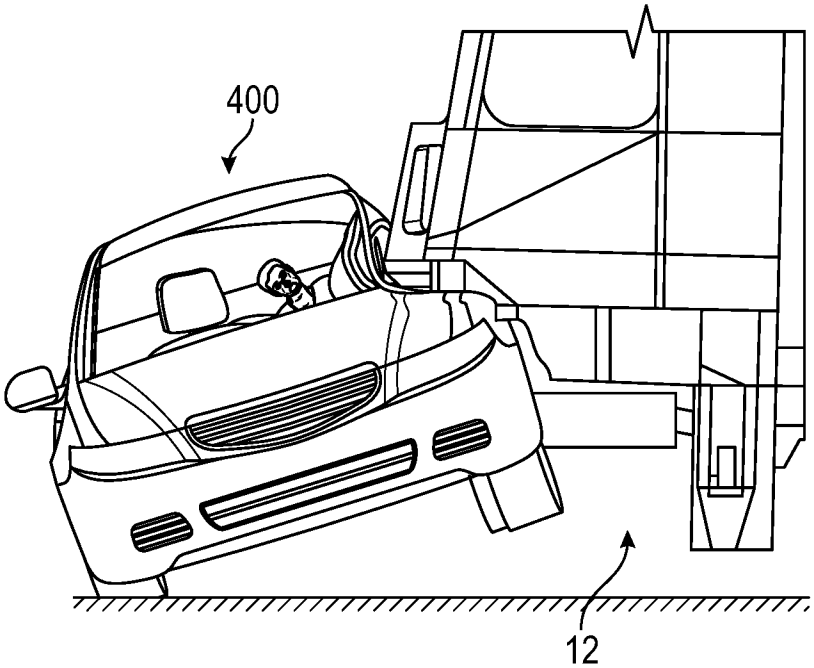
FIG. 23 depicts a collision between the prior art railway vehicle of FIG. 1 not having the enclosure system and a car.

As mentioned above, enclosure system 100 provides substantial benefits during a collision of a railway vehicle with another object (e.g., an automobile). Illustrated in FIGS. 23-24 are examples of collisions occurring between a railway vehicle and another vehicle. FIG. 23 illustrates an automobile 400 following a collision with a railway vehicle not having enclosure system 100. FIG. 24 illustrates an automobile 500 following a collision with a railway vehicle having enclosure system 100. Both FIGS. 23-24 are simulations of the railway vehicle colliding with an automobile under the same parameters (e.g., speed, angle, automobile type, etc.).

As illustrated in FIG. 23, automobile 400 is significantly damaged due to the collision with the railway vehicle. This is especially true due to gap 12, which is unprotected on prior art railway vehicles. Due to gap 12, automobile 400 is impacted with the sharp region of frame 10, just under anticlimber 16. Additionally, automobile 400 is pressed under and into gap 12. Further, in the case of automobile 400, the impact point of frame 10 with automobile 400 is located at a structurally weak portion (e.g., the windows). This impact point is also located very close to the upper body of any passengers within automobile 400.

As illustrated in FIG. 24, automobile 500 is much less damaged that automobile 400 following collision with the railway vehicle having enclosure system 100. Note that enclosure panel 102 contacts automobile 500 out in front of frame 10. Since enclosure panel 102 contacts automobile 500 well before frame 10, the enclosure panel 102 prevents the high impact damage that frame 10 and gap 12 cause to automobile 400. Additionally, as automobile 400 is low to the ground, frame 10 contacts the automobile 400 roughly around the same height as the passenger. This causes a significant increase in risk of the passenger being injured. As can be seen in FIG. 24, when enclosure panel 102 contacts automobile 500 at a much lower region, the frame of automobile 500 is more structurally sound and can absorb the blunter impact of enclosure panel 102 than impact by frame 10.

As described herein, enclosure system 100 provides significant advantages over the prior art. These advantages include: 1) easily attached to prior railway vehicle cars; 2) significantly decrease damage to the railway vehicle car and impacted object in a collision; 3) significantly reduce the likelihood of severe injuries of passengers of an impacted car in a collision; 4) easily adjustable between the deployed configuration and the stowed configuration, making it easy to alter railway vehicle size by adding or subtracting cars; and 5) doesn't obstruct the view of an operator of the railway vehicle when in the stowed configuration.

Features described above as well as those claimed below may be combined in various ways without departing from the scope hereof. The following examples illustrate some possible, non-limiting combinations:

(A1) A railway vehicle enclosure apparatus, including: an enclosure panel; one or more actuation systems, each including an actuating cylinder adapted to actuate the enclosure panel between a stowed configuration and a deployed configuration; and a breakaway system engaging lateral sides of the enclosure panel when in the deployed configuration, the breakaway system including: at least one breakaway panel abutting the lateral sides of the enclosure panel at a first end and configured to detach from the railway vehicle enclosure apparatus upon a force being exerted on the enclosure panel; and at least one breakaway block each having a guide slot, wherein the guide slot and the at least one breakaway block transiently maintain a position of the at least one breakaway panel.

(A2) For the railway vehicle enclosure apparatus denoted as (A1), the actuating cylinder is connected to a railway vehicle at a first end, and the one or more actuation systems each further include: a linkage drive crank connected to the actuating cylinder at a second end; and a linkage arm coupled to the linkage drive crank at a first end and the enclosure panel at a second end.

(A3) For the railway vehicle enclosure apparatus denoted as (A1) or (A2), actuation of the actuating cylinder drives rotation of the linkage drive crank, thereby rotating the linkage arm about the first end of the linkage arm and transitioning the enclosure panel between the deployed configuration and the stowed configuration.

(A4) For the railway vehicle enclosure apparatus denoted as any of (A1) through (A3), further including: a biasing member coupled to the railway vehicle and the linkage drive crank, the biasing member biasing the enclosure panel towards the stowed configuration.

(A5) For the railway vehicle enclosure apparatus denoted as any of (A1) through (A4), further including: a padding disposed on an internal side of the enclosure panel and configured to prevent longitudinal and lateral movement of the enclosure panel when in the stowed configuration.

(A6) For the railway vehicle enclosure apparatus denoted as any of (A1) through (A5), the breakaway system further includes: at least one shear block engaging a second end of the at least one breakaway panel via a connection block, each shear block including: a stationary block having a stationary slanted portion abutting the connection block; and a set screw configured to couple the connection block to the shear block.

(A7) For the railway vehicle enclosure apparatus denoted as any of (A1) through (A6), one or more of the guide slot and the stationary slanted portion are configured to guide the at least one breakaway panel outwardly from the railway vehicle enclosure apparatus when the force is exerted on the enclosure panel.

(A8) For the railway vehicle enclosure apparatus denoted as any of (A1) through (A7), further including: a coupler centering assembly disposed on the enclosure panel and configured to maintain a coupler of the railway vehicle in a forward direction when the enclosure panel is in the deployed configuration.

(A9) For the railway vehicle enclosure apparatus denoted as any of (A1) through (A8), the one or more actuation systems being disposed on the railway vehicle.

(A10) For the railway vehicle enclosure apparatus denoted as any of (A1) through (A9), the breakaway system being disposed on the railway vehicle.

(A11) For the railway vehicle enclosure apparatus denoted as any of (A1) through (A10), the enclosure panel being disposed on the railway vehicle.

(A12) For the railway vehicle enclosure apparatus denoted as any of (A1) through (A11), the railway vehicle enclosure apparatus being disposed on the railway vehicle.

(B1) An enclosure system for a railway vehicle, the enclosure system including: an enclosure panel; and a breakaway system engaging lateral sides of the enclosure panel, the breakaway system including: at least one breakaway panel abutting the lateral sides of the enclosure panel at a first end; one or more breakaway blocks transiently maintaining a position of the at least one breakaway panel; and one or more shear blocks engaging the at least one breakaway panel at a second end, the one or more breakaway blocks and the one or more shear blocks are configured to guide the at least one breakaway panel upon a force being exerted on the enclosure panel.

(B2) For the enclosure system denoted as (B1), each of the one or more breakaway blocks includes a guide slot engaging the at least one breakaway panel.

(B3) For the enclosure system denoted as (B1) or (B2), each of the one or more shear blocks includes: a connection block being partially received by the at least one breakaway panel at the second end; a stationary block having a stationary slanted portion abutting the connection block; and a set screw coupling the connection block to the stationary block at the stationary slanted portion.

(B4) For the enclosure system denoted as any of (B1) through (B3), the set screw includes a shear pin disposed at the abutment of the stationary slanted portion and the connection block, the shear pin configured to shear upon the force being exerted on the enclosure panel.

(B5) For the enclosure system denoted as any of (B1) through (B4), the enclosure panel includes a groove at the lateral sides having one or more connective extensions disposed therein, and the at least one breakaway panel includes a ridge configured to receive the one or more connective extensions and be received within the groove.

(B6) For the enclosure system denoted as any of (B1) through (B5), further including at least one linkage mount configured to attach to the railway vehicle, the one or more breakaway blocks are mechanically coupled to the at least one linkage mount.

(B7) For the railway vehicle enclosure apparatus denoted as any of (B1) through (B6), the breakaway system being disposed on the railway vehicle.

(B8) For the railway vehicle enclosure apparatus denoted as any of (B1) through (B7), the enclosure panel being disposed on the railway vehicle.

(B9) For the railway vehicle enclosure apparatus denoted as any of (B1) through (B8), the enclosure system being disposed on the railway vehicle.

(C1) An enclosure system for a railway vehicle, the enclosure system including: an enclosure panel; and one or more actuation mechanisms coupled to the enclosure panel, the one or more actuation mechanisms including: one or more linkage arms coupled to the enclosure panel; one or more linkage drive cranks coupled to the one or more linkage arms; and one or more actuating cylinders configured to drive rotation of the one or more linkage drive cranks, rotation of the one or more linkage drive cranks actuates the one or more linkage arms, thereby actuating the enclosure panel between a stowed configuration and a deployed configuration.

(C2) For the enclosure system denoted as (C1), further including a linkage mount having a receiving hole, and the one or more linkage drive cranks are coupled to at least one of the one or more linkage arms via an extending member, the extending member being received within and supported by the receiving hole of the linkage mount.

(C3) For the enclosure system denoted as (C1) or (C2), further including: a coupler centering assembly, including at least one horizontal corral and at least one vertical corral configured to bias a coupler of the railway vehicle towards and through the coupler centering assembly and maintain the coupler therethrough when the enclosure panel is in the deployed configuration.

(C4) For the enclosure system denoted as any of (C1) through (C3), while the enclosure panel is in the stowed configuration, the coupler is capable of attaching to another coupler of a separate railway vehicle.

(C5) For the enclosure system denoted as any of (C1) through (C4), further including a biasing member operatively connected to the one or more linkage drive cranks and biasing the enclosure panel towards the stowed configuration.

(C6) For the enclosure system denoted as any of (C1) through (C5), further including a receiving mechanism disposed on the railway vehicle and a pin disposed on the enclosure panel, the receiving mechanism configured to receive the pin and maintain the enclosure panel in the stowed configuration.

(C7) For the railway vehicle enclosure apparatus denoted as any of (C1) through (B6), the one or more actuation mechanisms being disposed on the railway vehicle.

(C8) For the railway vehicle enclosure apparatus denoted as any of (C1) through (C7), the enclosure panel being disposed on the railway vehicle.

(C9) For the railway vehicle enclosure apparatus denoted as any of (C1) through (C8), the enclosure system being disposed on the railway vehicle.

Although the present disclosure has been described with reference to the embodiments illustrated in the attached drawing figures, it is noted that equivalents may be employed and substitutions made herein without departing from the scope of the present disclosure as recited in the claims.

Having thus described various embodiments of the present disclosure, what is claimed as new and desired to be protected by Letters Patent includes the following:

1. A railway vehicle enclosure apparatus, comprising:
- an enclosure panel;
- one or more actuation systems, each comprising an actuating cylinder adapted to actuate the enclosure panel between a stowed configuration and a deployed configuration; and
- a breakaway system engaging lateral sides of the enclosure panel when in the deployed configuration, the breakaway system comprising:
  - at least one breakaway panel abutting the lateral sides of the enclosure panel at a first end and configured to detach from the railway vehicle enclosure apparatus upon a force being exerted on the enclosure panel; and
  - at least one breakaway block each having a guide slot, wherein the guide slot and the at least one breakaway block transiently maintain a position of the at least one breakaway panel.

2. The railway vehicle enclosure apparatus of claim 1, wherein the actuating cylinder is connected to a railway vehicle at a first end, and wherein the one or more actuation systems each further comprise:
- a linkage drive crank connected to the actuating cylinder at a second end; and
- a linkage arm coupled to the linkage drive crank at a first end and the enclosure panel at a second end.

3. The railway vehicle enclosure apparatus of claim 2, wherein actuation of the actuating cylinder drives rotation of the linkage drive crank, thereby rotating the linkage arm about the first end of the linkage arm and transitioning the enclosure panel between the deployed configuration and the stowed configuration.

4. The railway vehicle enclosure apparatus of claim 3, further comprising:
- a biasing member coupled to the railway vehicle and the linkage drive crank, the biasing member biasing the enclosure panel towards the stowed configuration.

5. The railway vehicle enclosure apparatus of claim 4, further comprising:
- a padding disposed on an internal side of the enclosure panel and configured to prevent longitudinal and lateral movement of the enclosure panel when in the stowed configuration.

6. The railway vehicle enclosure apparatus of claim 1, wherein the breakaway system further comprises:
- at least one shear block engaging a second end of the at least one breakaway panel via a connection block, each shear block comprising:
  - a stationary block having a stationary slanted portion abutting the connection block; and
  - a set screw configured to couple the connection block to the shear block.

7. The railway vehicle enclosure apparatus of claim 6, wherein one or more of the guide slot and the stationary slanted portion are configured to guide the at least one breakaway panel outwardly from the railway vehicle enclosure apparatus when the force is exerted on the enclosure panel.

8. The railway vehicle enclosure apparatus of claim 1, further comprising:

a coupler centering assembly disposed on the enclosure panel and configured to maintain a coupler of a railway vehicle in a forward direction when the enclosure panel is in the deployed configuration.

9. The railway vehicle enclosure apparatus of claim 1, further comprising a linkage mount having a receiving hole, and wherein one or more linkage drive cranks of the one or more actuation systems are coupled to one or more linkage arms via an extending member, the extending member being received within and supported by the receiving hole of the linkage mount.

10. An enclosure system for a railway vehicle, the enclosure system comprising:

an enclosure panel; and a breakaway system engaging lateral sides of the enclosure panel, the breakaway system comprising:

at least one breakaway panel abutting the lateral sides of the enclosure panel at a first end;

one or more breakaway blocks transiently maintaining a position of the at least one breakaway panel; and one or more shear blocks engaging the at least one breakaway panel at a second end, wherein the one or more breakaway blocks and the one or more shear blocks are configured to guide the at least one breakaway panel upon a force being exerted on the enclosure panel.

11. The enclosure system of claim 10, wherein each of the one or more breakaway blocks comprises a guide slot engaging the at least one breakaway panel.

12. The enclosure system of claim 11, wherein each of the one or more shear blocks comprises:

a connection block being partially received by the at least one breakaway panel at the second end;

a stationary block having a stationary slanted portion abutting the connection block; and a set screw coupling the connection block to the stationary block at the stationary slanted portion.

13. The enclosure system of claim 12, wherein the set screw comprises a shear pin disposed at the abutment of the stationary slanted portion and the connection block, the shear pin configured to shear upon the force being exerted on the enclosure panel.

14. The enclosure system of claim 13, wherein the enclosure panel comprises a groove at the lateral sides having one or more connective extensions disposed therein, and wherein the at least one breakaway panel comprises a ridge configured to receive the one or more connective extensions and be received within the groove.

15. The enclosure system of claim 14, further comprising at least one linkage mount configured to attach to the railway vehicle, wherein the one or more breakaway blocks are coupled to the at least one linkage mount.

16. An enclosure system for a railway vehicle, the enclosure system comprising:

an enclosure panel;

one or more actuation mechanisms coupled to the enclosure panel, the one or more actuation mechanisms comprising:

one or more linkage arms coupled to the enclosure panel;

one or more linkage drive cranks coupled to the one or more linkage arms; and one or more actuating cylinders configured to drive rotation of the one or more linkage drive cranks, wherein rotation of the one or more linkage drive cranks actuates the one or more linkage arms, thereby actuating the enclosure panel between a stowed configuration and a deployed configuration; and a coupler centering assembly, comprising at least one horizontal corral and at least one vertical corral configured to bias a coupler of the railway vehicle towards and through the coupler centering assembly and maintain the coupler therethrough when the enclosure panel is in the deployed configuration.

17. The enclosure system of claim 16, further comprising a linkage mount having a receiving hole, and wherein the one or more linkage drive cranks are coupled to at least one of the one or more linkage arms via an extending member, the extending member being received within and supported by the receiving hole of the linkage mount.

18. The enclosure system of claim 16, wherein while the enclosure panel is in the stowed configuration, the coupler is capable of attaching to another coupler of a separate railway vehicle.

19. The enclosure system of claim 16, further comprising a biasing member operatively connected to the one or more linkage drive cranks and biasing the enclosure panel towards the stowed configuration.

20. The enclosure system of claim 16, further comprising a receiving mechanism disposed on the railway vehicle and a pin disposed on the enclosure panel, the receiving mechanism configured to receive the pin and maintain the enclosure panel in the stowed configuration.

* * * * *